US007744300B2

(12) United States Patent
Cheng et al.

(10) Patent No.: US 7,744,300 B2
(45) Date of Patent: Jun. 29, 2010

(54) READY LOCK RING BINDER MECHANISM

(75) Inventors: Hung Yu Cheng, Hong Kong (CN); Ho Ping Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 9 days.

(21) Appl. No.: 11/954,990

(22) Filed: Dec. 12, 2007

(65) Prior Publication Data

US 2008/0089736 A1 Apr. 17, 2008

Related U.S. Application Data

(60) Division of application No. 10/870,801, filed on Jun. 17, 2004, now Pat. No. 7,549,817, which is a continuation-in-part of application No. 10/323,052, filed on Dec. 18, 2002, now Pat. No. 7,296,946.

(60) Provisional application No. 60/553,154, filed on Mar. 15, 2004.

(51) Int. Cl.
*B42F 3/04* (2006.01)

(52) U.S. Cl. ..... 402/31

(58) Field of Classification Search ..... 402/19, 402/26, 36, 37, 39, 41, 42, 70, 73, 34
See application file for complete search history.

(56) References Cited

U.S. PATENT DOCUMENTS 419,160 A 1/1890 Smith
566,717 A 8/1896 Krah
621,256 A 3/1899 Krah
651,254 A 6/1900 Krah
683,019 A 9/1901 Buchanan (Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admitted as prior art, 12 pgs.

(Continued)

*Primary Examiner*—Dana Ross
*Assistant Examiner*—Matthew G Katcoff
(74) *Attorney, Agent, or Firm*—Senniger Powers LLP

(57) ABSTRACT

A ring binder mechanism that retains loose-leaf pages and has ring members that readily lock together, preventing accidental loss of pages. The mechanism comprises a housing that supports two hinge plates for pivoting motion, bringing the ring members to either an open position or a closed position. The mechanism further comprises a control structure, which includes an actuator moveable relative to the housing for controlling pivoting movement of the hinge plates. The actuator is connected to a travel bar that is moveable by the actuator into position for blocking pivoting motion of the hinge plates when the ring members are closed. The connection of the travel bar to the actuator permits the actuator to move in a range without actuating corresponding movement of the travel bar.

17 Claims, 28 Drawing Sheets

U.S. PATENT DOCUMENTS

| | | | | |
|---|---|---|---|---|
| 779,879 | A | 1/1905 | Sheridan | |
| 790,382 | A | 5/1905 | McBride | |
| 854,074 | A | 5/1907 | Bryant | |
| 857,377 | A | 6/1907 | Baker | |
| 974,831 | A | 11/1910 | Scherzinger | |
| 1,011,391 | A | 12/1911 | Sturgis | |
| 1,163,179 | A | 12/1915 | Schade, Jr. | |
| 1,168,260 | A | 1/1916 | Albrecht | |
| 1,398,034 | A | 11/1921 | Mero | |
| 1,398,388 | A | 11/1921 | Murphy | |
| 1,598,206 | A | 8/1926 | Lindstedt | |
| 1,733,548 | A | 10/1929 | Martin | |
| 1,733,894 | A | 10/1929 | Martin | |
| 1,787,957 | A | 1/1931 | Schade | |
| 1,822,669 | A | 9/1931 | Schade | |
| 1,824,791 | A | 9/1931 | Rengmann | |
| 1,857,291 | A | 5/1932 | Trussell | |
| 1,953,981 | A | 4/1934 | Trussell | |
| 1,991,362 | A | 2/1935 | Krag | |
| 1,996,463 | A | 4/1935 | Dawson | |
| 2,004,570 | A | 6/1935 | Dawson | |
| 2,013,416 | A | 9/1935 | McClure | |
| 2,024,461 | A | 12/1935 | Lotter | |
| 2,067,846 | A | 1/1937 | Cooper | |
| 2,075,766 | A | 3/1937 | Rand | |
| 2,075,767 | A | 3/1937 | Rand | |
| 2,081,372 | A | 5/1937 | Thomas | |
| 2,089,211 | A | 8/1937 | Krag | |
| 2,096,944 | A | 10/1937 | Unger | |
| 2,103,307 | A | 12/1937 | Unger | |
| 2,105,235 | A | 1/1938 | Schade | |
| 2,158,056 | A | 5/1939 | Cruzan | |
| 2,179,627 | A | 11/1939 | Handler | |
| 2,204,918 | A | 6/1940 | Trussell | |
| 2,218,105 | A | 10/1940 | Griffin | |
| 2,236,321 | A | 3/1941 | Ostrander | |
| 2,239,062 | A | 4/1941 | Tallmadge | |
| 2,239,121 | A | 4/1941 | St. Louis | |
| 2,251,878 | A | 8/1941 | Hanna | |
| 2,252,422 | A | 8/1941 | Unger | |
| 2,260,929 | A | 10/1941 | Bloore | |
| 2,288,189 | A | 6/1942 | Guinane | |
| 2,304,716 | A | 12/1942 | Supin | |
| 2,311,492 | A | 2/1943 | Unger | |
| 2,322,595 | A | 6/1943 | Schade | |
| 2,338,011 | A | 12/1943 | Schade | |
| 2,421,799 | A | 6/1947 | Martin | |
| 2,528,866 | A | 11/1950 | Dawson, Jr. | |
| 2,543,866 | A | 3/1951 | Panfil | |
| 2,552,076 | A | 5/1951 | Wedge | |
| 2,570,323 | A | 10/1951 | Condon | |
| 2,612,169 | A | 9/1952 | Segal | |
| 2,789,561 | A * | 4/1957 | Hammerschlag et al. | 402/35 |
| 2,865,377 | A | 12/1958 | Schroer | |
| 2,871,711 | A | 2/1959 | Stark | |
| 2,891,553 | A | 6/1959 | Acton | |
| 2,894,513 | A | 7/1959 | Gempe | |
| 3,077,888 | A | 2/1963 | Thieme | |
| 3,098,489 | A | 7/1963 | Vernon | |
| 3,098,490 | A | 7/1963 | Wance | |
| 3,101,719 | A | 8/1963 | Vernon | |
| 3,104,667 | A | 9/1963 | Mintz | |
| 3,149,636 | A | 9/1964 | Rankin | |
| 3,190,293 | A | 6/1965 | Schneider | |
| 3,205,894 | A | 9/1965 | Rankin | |
| 3,205,895 | A | 9/1965 | Johnson | |
| 3,255,759 | A | 6/1966 | Dennis | |
| 3,348,550 | A | 10/1967 | Wolf | |
| 3,718,402 | A | 2/1973 | Schade | |
| 3,748,051 | A | 7/1973 | Frank | |
| 3,884,586 | A | 5/1975 | Michaelis | |
| 3,954,343 | A | 5/1976 | Thomsen | |
| 3,993,374 | A | 11/1976 | Schudy | |
| 4,127,340 | A | 11/1978 | Almgren | |
| 4,130,368 | A | 12/1978 | Jacoby | |
| 4,352,582 | A | 10/1982 | Eliasson | |
| 4,486,112 | A | 12/1984 | Cummins | |
| 4,522,526 | A | 6/1985 | Lozfau | |
| 4,566,817 | A | 1/1986 | Barrett, Jr. | |
| 4,571,108 | A | 2/1986 | Vogl | |
| 4,696,595 | A | 9/1987 | Pinkney | |
| 4,798,491 | A | 1/1989 | Lassle | |
| 4,813,803 | A | 3/1989 | Gross | |
| 4,815,882 | A | 3/1989 | Ohminato | |
| 4,886,390 | A | 12/1989 | Silence | |
| 4,919,557 | A | 4/1990 | Podosek | |
| 5,067,840 | A | 11/1991 | Cooper | |
| 5,116,157 | A | 5/1992 | Gillum | |
| 5,135,323 | A | 8/1992 | Pinheiro | |
| 5,180,247 | A | 1/1993 | Yu | |
| 5,255,991 | A | 10/1993 | Sparkes | |
| 5,286,128 | A | 2/1994 | Gillum | |
| 5,332,327 | A | 7/1994 | Gillum | |
| 5,346,325 | A | 9/1994 | Yamanoi | |
| 5,354,142 | A | 10/1994 | Yu | |
| 5,368,407 | A | 11/1994 | Law | |
| 5,378,073 | A | 1/1995 | Law | |
| 5,393,156 | A | 2/1995 | Mullin | |
| 5,476,335 | A | 12/1995 | Whaley | |
| 5,524,997 | A | 6/1996 | von Rohrscheidt | |
| 5,577,852 | A | 11/1996 | To | |
| 5,634,666 | A | 6/1997 | Lee | |
| 5,651,628 | A | 7/1997 | Bankes | |
| 5,660,490 | A | 8/1997 | Warrington | |
| 5,692,847 | A | 12/1997 | Zane | |
| 5,692,848 | A | 12/1997 | Wada | |
| 5,718,529 | A | 2/1998 | Chan | |
| 5,782,569 | A | 7/1998 | Mullin | |
| 5,788,392 | A | 8/1998 | Cheung | |
| 5,807,006 | A | 9/1998 | Cheung | |
| 5,810,499 | A | 9/1998 | Law | |
| 5,816,729 | A | 10/1998 | Whaley | |
| 5,836,709 | A | 11/1998 | Cheung | |
| 5,868,513 | A | 2/1999 | Law | |
| 5,879,097 | A | 3/1999 | Cheng | |
| 5,882,135 | A | 3/1999 | Ko | |
| 5,895,164 | A | 4/1999 | Wu | |
| 5,924,811 | A | 7/1999 | To | |
| 5,957,611 | A | 9/1999 | Whaley | |
| 5,975,784 | A | 11/1999 | Whaley | |
| 5,975,785 | A | 11/1999 | Chan | |
| 6,036,394 | A | 3/2000 | Cheng | |
| 6,142,697 | A | 11/2000 | Williams | |
| 6,146,042 | A | 11/2000 | To | |
| 6,155,737 | A | 12/2000 | Whaley | |
| 6,203,229 | B1 * | 3/2001 | Coerver | 402/38 |
| 6,206,601 | B1 | 3/2001 | Ko | |
| 6,217,247 | B1 | 4/2001 | Ng | |
| 6,270,279 | B1 | 8/2001 | Whaley | |
| 6,276,862 | B1 * | 8/2001 | Snyder et al. | 402/40 |
| 6,293,722 | B1 | 9/2001 | Holbrook | |
| 6,364,558 | B1 | 4/2002 | To | |
| 6,371,678 | B1 | 4/2002 | Chizmar | |
| 6,467,984 | B1 | 10/2002 | To | |
| 6,474,897 | B1 | 11/2002 | To | |
| 6,533,486 | B1 | 3/2003 | To | |
| 6,749,357 | B2 | 6/2004 | Cheng | |
| 6,758,621 | B2 | 7/2004 | To | |
| 6,821,045 | B2 | 11/2004 | Whaley | |
| 6,840,695 | B2 * | 1/2005 | Horn | 402/31 |
| 6,916,134 | B2 | 7/2005 | Wong | |
| 7,296,946 | B2 | 11/2007 | Cheng | |
| 2002/0122687 | A1 * | 9/2002 | Horn | 402/16 |
| 2003/0044221 | A1 * | 3/2003 | To et al. | 402/41 |

| | | | |
|---|---|---|---|
| 2003/0103797 | A1 | 6/2003 | Cheng |
| 2003/0123923 | A1 | 7/2003 | Koike |
| 2005/0013654 | A1 | 1/2005 | Cheng |
| 2005/0201817 | A1 | 9/2005 | Cheng |
| 2005/0201818 | A1 | 9/2005 | Cheng |
| 2005/0201819 | A1 | 9/2005 | Cheng |
| 2005/0201820 | A1 | 9/2005 | Ng |
| 2005/0207826 | A1 | 9/2005 | Cheng |
| 2005/0214064 | A1 | 9/2005 | Ng |
| 2005/0232689 | A1 | 10/2005 | Cheng |
| 2006/0008318 | A1 | 1/2006 | Ng |
| 2006/0056906 | A1 | 3/2006 | Horn |
| 2006/0088365 | A1 | 4/2006 | Whaley |
| 2006/0147253 | A1 | 7/2006 | Cheng |
| 2006/0147254 | A1 | 7/2006 | Cheng |
| 2006/0147255 | A1 | 7/2006 | Cheng |
| 2006/0153628 | A1 | 7/2006 | Tanaka |
| 2006/0153629 | A1 | 7/2006 | Cheng |
| 2006/0216107 | A1 | 9/2006 | Lin |
| 2006/0228164 | A1 | 10/2006 | Horn |
| 2006/0251467 | A1 | 11/2006 | Cheng |
| 2006/0251468 | A1 | 11/2006 | Cheng |
| 2007/0086836 | A1 | 4/2007 | Cheng |
| 2007/0140778 | A1 | 6/2007 | Lin |
| 2007/0160415 | A1 | 7/2007 | To et al. |
| 2008/0075526 | A1 | 3/2008 | Ng |
| 2008/0075527 | A1 | 3/2008 | Pi |
| 2008/0124166 | A1 | 5/2008 | Zhang et al. |

FOREIGN PATENT DOCUMENTS

| | | | |
|---|---|---|---|
| EP | 1316438 | A1 | 6/2003 |
| EP | 1323545 | A2 | 7/2003 |
| EP | 1431065 | A2 | 6/2004 |
| FR | 1336765 | | 9/1963 |
| FR | 1346864 | | 12/1963 |
| FR | 2221924 | | 10/1974 |
| FR | 22221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 2231536 | A1 | 11/1990 |
| GB | 2251215 | A1 | 7/1992 |
| GB | 2275023 | A1 | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 01299095 | A | 12/1989 |
| JP | 1299095 | A1 | 12/1989 |
| JP | 2034289 | U | 3/1990 |
| JP | 4120085 | | 10/1992 |
| JP | 10217662 | | 8/1998 |
| JP | 2004098417 | A | 4/2004 |
| WO | 0119620 | A1 | 3/2001 |
| WO | 0181099 | A1 | 11/2001 |

OTHER PUBLICATIONS

Apr. 20, 2007 Office Action and references in related U.S. Appl. No. 10/323,052, 13 pages.

May 31, 2005 Office Action and references in related U.S. Appl. No. 10/323,052, 11 pages.

Mar. 21, 2005 Office Action in related U.S. Appl. No. 10/323,052, 7 pages.

Sep. 30, 2004 Office Action and references in related U.S. Appl. No. 10/323,052, 8 pages.

Nov. 23, 2007 Office Action and references in related U.S. Appl. No. 10/870,801, 12 pages.

EPO Search Report for EP 05 011 914.8 dated Dec. 27, 2007, 4 pages.

Response filed Jun. 3, 2008 to Office Action dated Mar. 3, 2008 from related U.S. Appl. No. 11/140,728, 12 pgs.

Response filed Jan. 28, 2008 to Office Action dated Nov. 23, 2008 from related U.S. Appl. No. 10/870,801, 10 pgs.

Office Action dated Jun. 13, 2008 from related U.S. Appl. No. 10/870,801, 10 pgs.

Response filed Sep. 9, 2008 to Office Action dated Jun. 13, 2008 from related U.S. Appl. No. 10/870,801, 10 pgs.

Response filed Jan. 8, 2009 to Office Action dated Sep. 10, 2008 from related U.S. Appl. No. 11/140,728, 12 pgs.

Response filed Jul. 3, 2007 to Office Action dated Apr. 20, 2009 from related U.S. Appl. No. 10/323,052 (Patent No. 7,296,946), 15 pgs.

Mar. 3, 2008 Office Action and references in related U.S. Appl. 11/140,728, 51 pages.

Office Action dated Mar. 3, 2008 from related U.S. Appl. No. 11/140,728, 12 pgs.

Office Action dated Sep. 10, 2008 from related U.S. Appl. No. 11/140,728, 8 pgs.

Office action issued Mar. 31, 2009 from related U.S. Appl. No. 11/140,728, 13 pgs.

Third-Party Submission in Published Application Under 37 CFR 1.99(a) dated Apr. 3, 2009 from related U.S. Appl. No. 12/256,229, 3 pgs .

Office action dated Jun. 24, 2009 from related U.S. Appl. No. 12/256,229, 10 pgs.

"Joint Memorandum in Support of Motion for Claim Construction by the Court Regarding U.S. Patent No. 7,404,685" from litigation concerning related U.S. Patent 7,404,685, 517 pages.

"Defendant U.S. Ring Binder, L.P.'s Response to Plaintiff's Proposed Claim Constructions Regarding U.S. Patent No. 7,404,685" from litigation concerning related U.S. Patent 7,404,685, 26 pages.

"Plaintiff World Wide Stationery Manufacturing Co. Ltd.'s Response to Defendant's Proposed Claim Construction of U.S. Patent No. 7,404,685" from litigation concerning related U.S. Patent 7,404,685, 123 pages.

"Markman Hearing Transcript" [transcript of "Markman Hearing"] from litigation concerning related U.S. Patent 7,404,685, 148 pages.

"Plaintiffs Post-Hearing Claim Construction Brief" from litigation concerning related U.S. Patent 7,404,685, 640 pages.

"Defendant U.S. Ring Binder, L.P.'s Supplemental Brief Regarding Claim Construction" from litigation concerning related U.S. Patent 7,404,685, 177 pages.

"List of Disputed and Non-Disputed Claim Terms" from litigation concerning related U.S. Patent 7,404,685, 3 pages.

"Opening Expert Report of Dr. Virgil J. Flanigan" from litigation concerning related U.S. Patent 7,404,685, 175 pages.

"Expert Witness Report of Jeffrey K. Ball, Ph.D., P.E." from litigation concerning related U.S. Patent 7,404,685, 166 pages.

"Defendant U.S. Ring Binder LP's Motion, Statement of Undisputed Material Facts, and Memorandum in Support of Motion for Summary Judgment of Non-Infringement of U.S. Patent No. 7,296,946" from litigation concerning related U.S. Patent 7,404,685, 95 pages.

"Memorandum and Order" from litigation concerning related U.S. Patent 7,404,685, 39 pages.

"Supplemental Report of Jeffrey K. Ball, Ph.D., P.E." from litigation concerning related U.S. Patent 7,404,685, 6 pages.

"Expert Witness Report of Jeffrey K. Ball, Ph.D., P.E." from litigation concerning related U.S. Patent 7,404,685, 53 pages.

"Defendant's Supplemental Motion for Summary Judgment of Non-Infringment of U.S. Patent No. 7,296,946 and U.S. Patent No. 7,404,685" from litigation concerning related U.S. Patent 7,404,685, 176 pages.

"Statement of Uncontroverted Material Facts in Support of Plaintiffs Motion for Partial Summary Judgment on the Issue of Infringement of U.S. Patent No. 7,404,685" from litigation concerning related U.S. Patent 7,404,685, 126 pages.

"Motion for Summary Judgment of Non-Infringement of U.S. Patent No. 7,296,946 and Motion for Summary Judgment of Invalidity of U.S. Patent No. 7,296,946 Based on Improper Inventorship" from litigation concerning related U.S. Patent 7,404,685, 2 pages.

"Plaintiffs Motion for Partial Summary Judgment on the Issue of Infringement of U.S. Patent No. 7,404,685" from litigation concerning related U.S. Patent 7,404,685, 3 pages.

"Memorandum in Support of Plaintiffs Motion for Partial Summary Judgment on the Issue of Infringement of U.S. Patent No. 7,404,685" from litigation concerning related U.S. Patent 7,404,685, 14 pages.

"Plaintiff's Response to Defendant's Statement of Undisputed Material Facts in Support of Motion for Summary Judgment of Non-Infringement of U.S. Patent No. 7,296,946 and Plaintiff's Statement of Additional Material Facts" from litigation concerning related U.S. Patent 7,404,685, 9 pages.

"Supplemental Report of Jeffrey K. Ball, Ph.D., P.E." from litigation concerning related U.S. Patent 7,404,685, 6 pages.

"Memorandum in Opposition to Plaintiff's Motion for Partial Summary Judgment on the Issue of Infringement of U.S. Patent No. 7,404,685" from litigation concerning related U.S. Patent 7,404,685, 18 pages.

"Plaintiffs Response in Opposition to Defendant's Motion for Summary Judgment of Non-Infringement of U.S. Patent No. 7,296,946" from litigation concerning related U.S. Patent 7,404,685, 5 pages.

"Supplemental Expert Report of Dr. Virgil J. Flanigan" from litigation concerning related U.S. Patent 7,404,685, 19 pages.

"U.S. Ring Binder LP's Reply Brief in Support of Its Motions for Summary Judgment of Non-Infringement of U.S. Patent No. 7,296,946 and U.S. Patent No. 7,404,685" from litigation concerning related U.S. Patent 7,404,685, 4 pages.

"Reply Memorandum in Support of Plaintiffs Motion for Partial Summary Judgment on the Issue of Infringement of U.S. Patent No. 7,404,685" from litigation concerning related U.S. Patent 7,404,685, 10 pages.

"Rebuttal Report of Dr. Virgil J. Flanigan in Response to the Expert Report, Declaration and Supplemental Report of Jeffrey K. Ball" from litigation concerning related U.S. Patent 7,404,685, 10 pages.

Response filed Jun. 22, 2009 to Office action dated Mar. 31, 2009 in related U.S. Patent Application Serial No. 11/140,728, 14 pgs.

"Memorandum in Support of Plaintiffs Motion for Reconsideration of the Court's Claim Construction Ruling" from litigation concerning related U.S. Patent 7,404,685, 16 pages.

Office action dated Sep. 29, 2009 from related U.S. Appl. No. 11/140,728, 16 pgs.

"Amended Memorandum and Order" from litigation concerning related U.S. Patent 7,404,685, 33 pages.

"Expert Witness Report on Invalidity of Jeffrey K. Ball, Ph.D., P.E." from U.S. Ring Binder, *L.P. v. Staples The Office Superstore LLC, et al.*, 39 pages.

Response filed Oct. 26, 2009 to Office action dated Jun. 24, 2009 in related U.S. Patent Application Serial No. 12/256,229, 13 pages.

Office action issued Nov. 23, 2009 in related U.S. Appl. No. 12/256,229, 13 pages.

* cited by examiner

READY LOCK RING BINDER MECHANISM

CROSS-REFERENCE TO RELATED APPLICATIONS

This application is a Divisional of U.S. patent application Ser. No. 10/870,801 filed Jun. 17, 2004, which is a Continuation-In-Part of U.S. patent application Ser. No. 10/323,052, filed Dec. 18, 2002 (now U.S. Pat. No. 7,296,946), and a non-provisional application of U.S. patent application Ser. No. 60/553,154, filed Mar. 15, 2004, the entire texts of which are hereby incorporated by reference.

BACKGROUND OF THE INVENTION

This invention relates to a ring binder mechanism for retaining loose-leaf pages, and in particular to an improved mechanism for opening and closing ring members and for readily and securely locking ring members together.

As is known in the art, a typical ring binder mechanism retains loose-leaf pages, such as hole-punched papers, in a file or notebook. It generally features multiple rings each including two half ring members capable of selectively opening to add or remove pages, or selectively closing to retain pages and allow them to move along the ring members. The ring members mount on two adjacent hinge plates that join together about a pivot axis for pivoting movement within an elongated housing. The housing loosely holds the hinge plates so they may pivot relative to the housing. The undeformed housing is slightly narrower than the joined hinge plates when the hinge plates are in a coplanar position (180°). So as the hinge plates pivot through this position, they deform the resilient housing and cause a spring force in the housing urging the hinge plates to pivot away from the coplanar position either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. In addition, in some mechanisms the operator may move a lever located at one or both ends of the mechanism for moving the hinge plates through the coplanar position to open or close the ring members (in addition to manually pulling the ring members apart or pushing them together).

One drawback to these typical ring binder mechanisms is that when the ring members close, the housing's spring force snaps them together rapidly and with a force that might cause fingers to be pinched between the ring members. The substantial spring force required to keep the ring members closed also makes pivoting the hinge plates through the coplanar position (180°) difficult so that it is hard to both open and close the ring members. Another drawback is that when the ring members are closed, they do not positively lock together. So if the mechanism is accidentally dropped, the ring members may unintentionally open. Still another drawback is that over time the housing may begin to permanently deform, reducing its ability to uniformly clamp the ring members together and possibly causing uneven movements or gaps between closed ring members.

To address these concerns, some ring binder mechanisms include a control slide attached directly to the lever. These control slides have inclined cam surfaces that project through openings in the hinge plates for rigidly controlling the hinge plates' pivoting motion both when opening and closing the ring members. Examples of these types of mechanisms are shown in U.S. Pat. Nos. 4,566,817, 4,571,108, and 6,276,862 and in U.K. Pat. No. 2,292,343. Some of these cam surfaces have a stop for blocking the hinge plates' pivoting motion when the ring members are closed and for locking the closed ring members together. An operator may open or close these mechanisms by either manipulating the ring members or moving the lever. But to lock the mechanisms, the operator must move the lever and the control slide to position the stops to block the hinge plates from pivoting.

These mechanisms still have several drawbacks. When the ring members close, the housing's spring force may still snap them together. The spring force may also still make both opening and closing the ring members difficult. In addition, when the mechanisms close they do not readily lock. Instead, an operator must directly move the lever and control slide to lock the mechanisms. Furthermore, the control slides in these mechanisms, specifically their inclined cam surfaces and stops, are complexly shaped and can be difficult and time consuming to fabricate. Moreover, since the control slides directly bias the hinge plates, they are usually relatively wide and may need to be constructed of a large gauge metal to withstand forces associated with repeated use (i.e., repeatedly driving the hinge plates to pivot). Therefore, the openings in the hinge plates receiving these control slides may also be relatively wide, possibly weakening the hinge plates so that they too must be made of a large gauge metal. This may make mass production more costly.

Consequently, there is a need for a ring binder mechanism that readily locks when ring members close for retaining loose-leaf pages, but has ring members that easily open and close and do not snap together. The present invention is directed to such a ring binder mechanism.

SUMMARY OF THE INVENTION

In one aspect of the present invention, a ring binder mechanism generally comprises a housing and hinge plates supported by the housing for pivoting motion about a pivot axis relative to the housing. The mechanism has rings for holding loose-leaf pages. Each ring includes a first ring member mounted on a first hinge plate and moveable with the pivoting motion of the first hinge plate. Each ring further includes a second ring member. The first ring member is movable relative to the second ring member so that in a closed position the two ring members form a substantially continuous, closed loop for allowing loose-leaf pages retained by the rings to be moved along the rings from one ring member to the other. In an open position the two ring members form a discontinuous, open loop for adding or removing loose-leaf pages from the rings. An actuator is pivotally mounted on the housing and movable relative to the housing for controlling the pivoting motion of the hinge plates opening and closing the ring members. A travel bar has a connection to the actuator for being moved by the actuator into position for blocking the pivoting motion of the hinge plates when the ring members are closed. The connection of the travel bar to the actuator permits the actuator to move in a range without actuating corresponding movement of the travel bar.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

This application contains subject matter in common with co-assigned, co-pending patent applications Ser. No. 10/870,165 filed Jun. 17, 2004 for a Soft Close Ring Binder Mechanism and Ser. No. 10/870,168 filed Jun. 17, 2004 for a Positive Lock Ring Binder Mechanism, the entire texts of which are hereby incorporated by reference.

Figure 1:
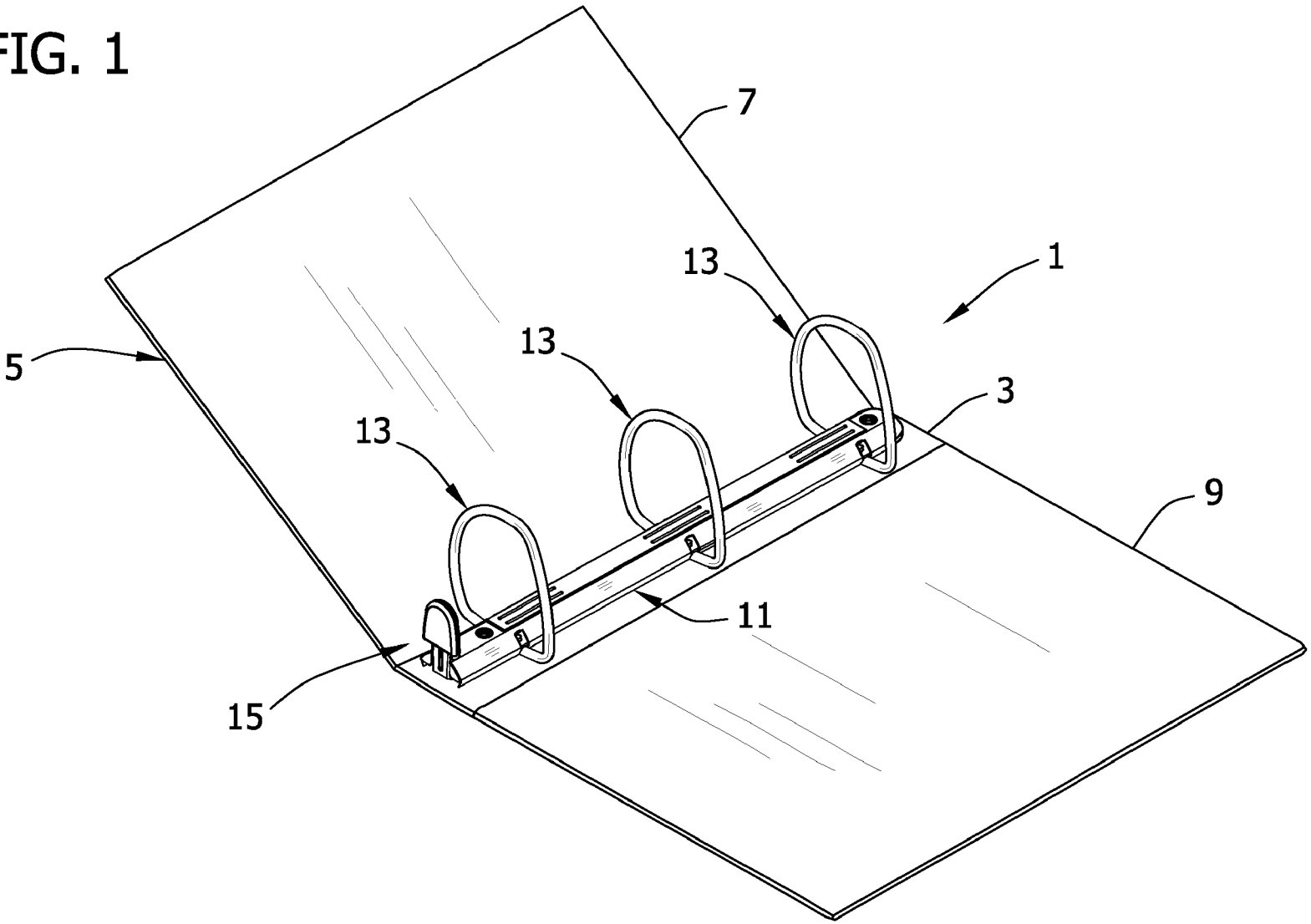
FIG. 1 is a perspective of a notebook incorporating a ring binder mechanism of the present invention according to a first embodiment.
Figure 2A:
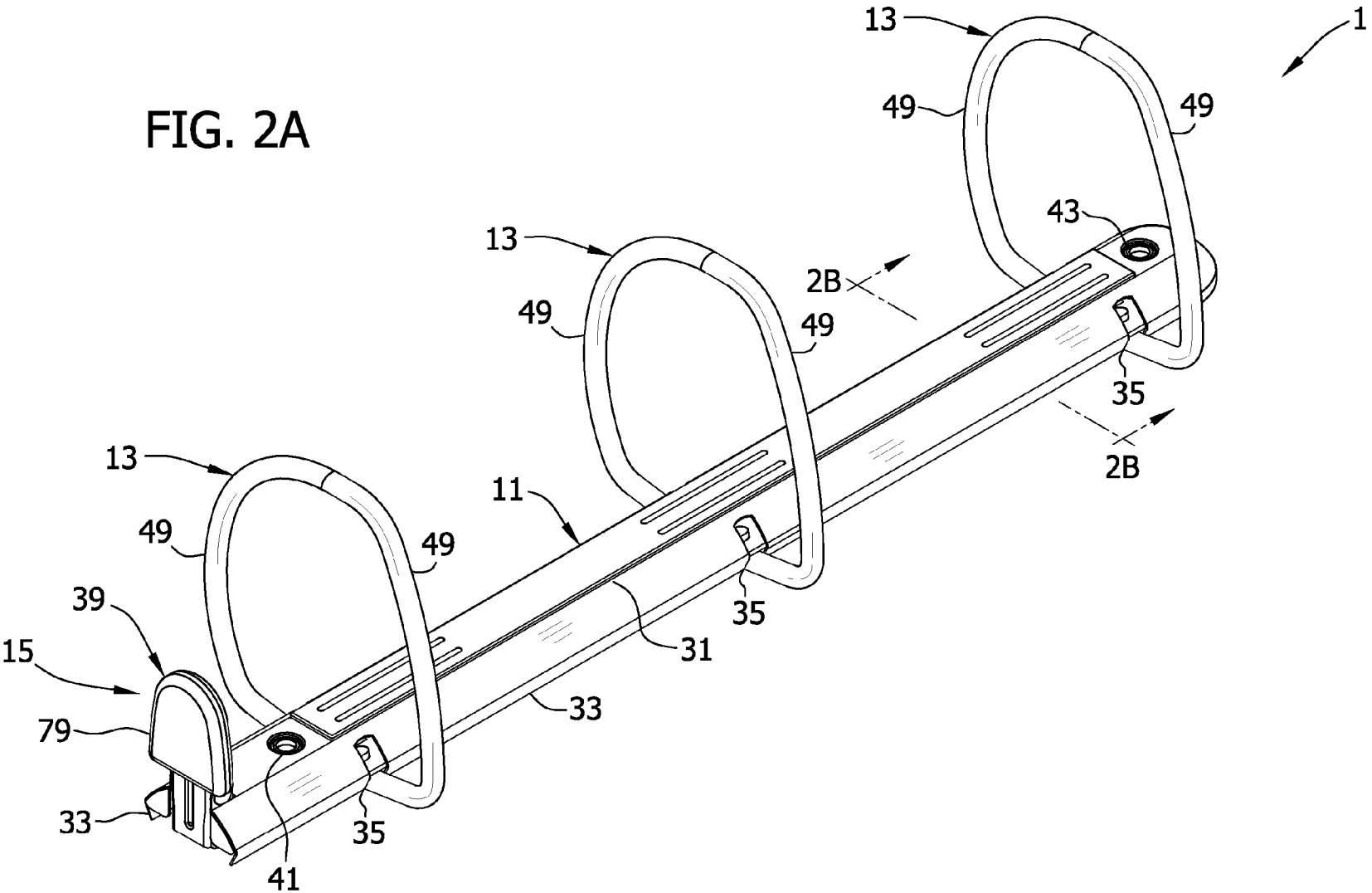
FIG. 2A is a perspective of the ring binder mechanism at a closed and locked position.
Figure 2B:
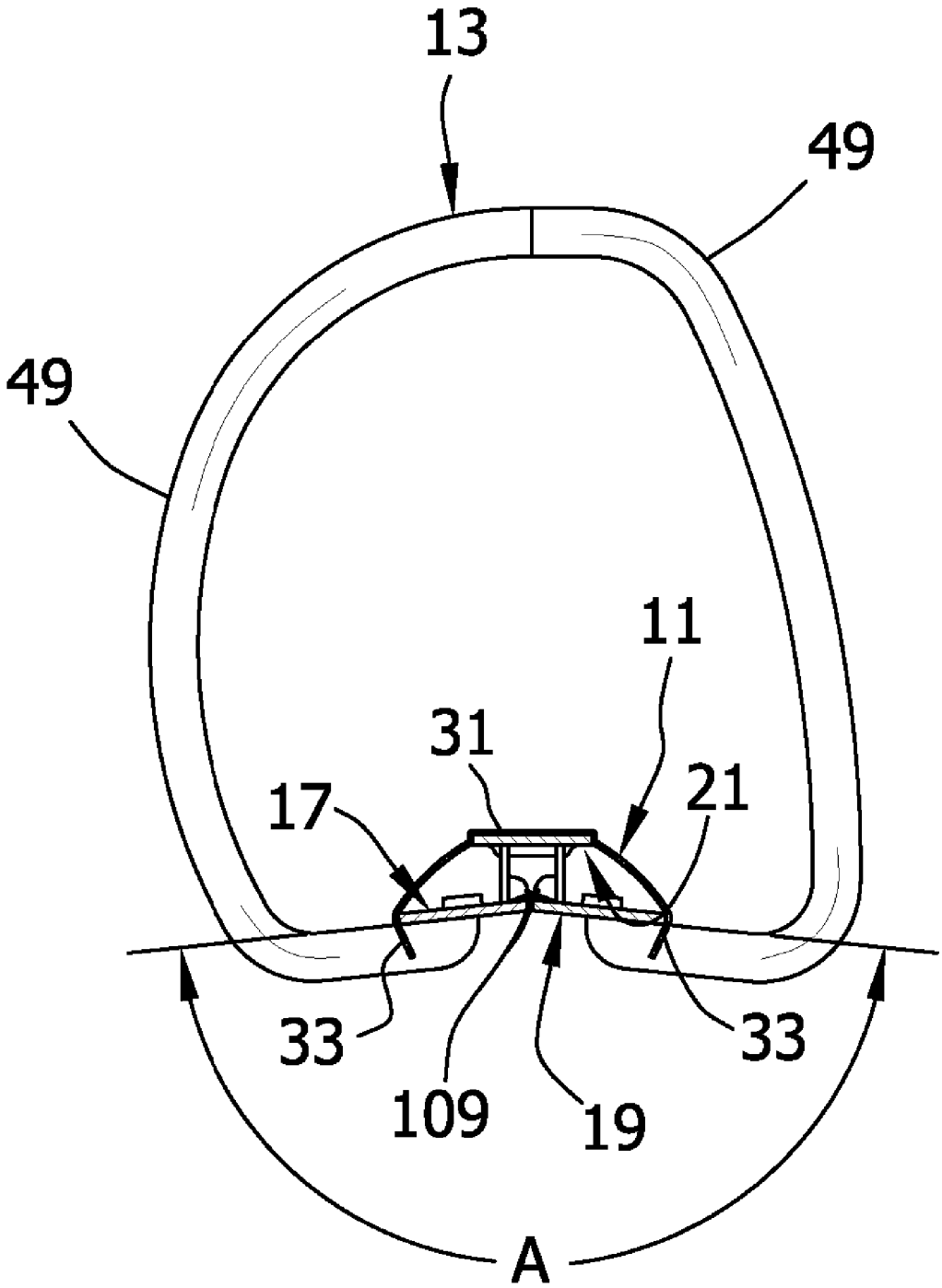
FIG. 2B is a section taken on line 2B-2B of FIG. 2A.
Figure 3A:
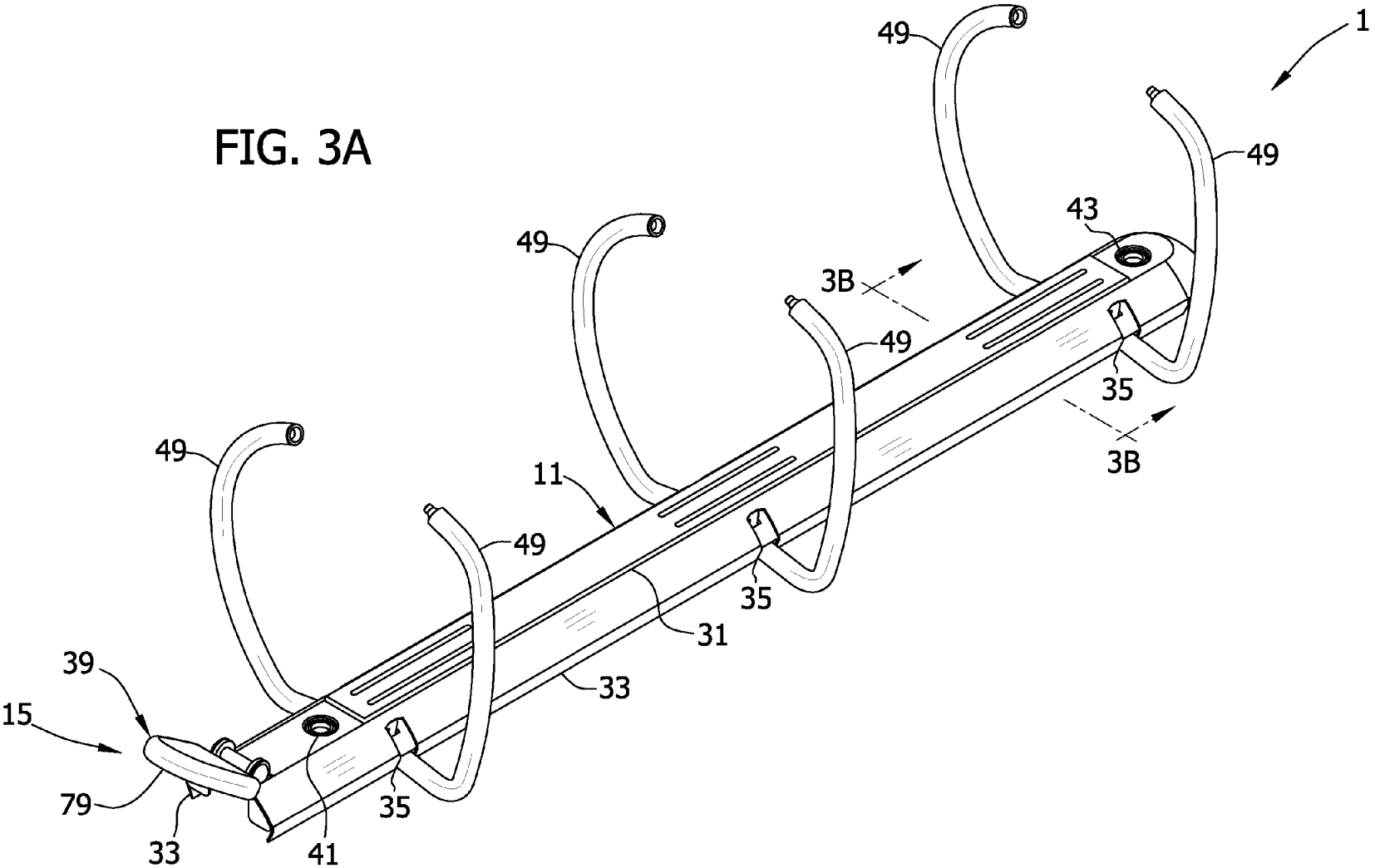
FIG. 3A is a perspective similar to FIG. 2A with the mechanism at an open position.
Figure 3B:
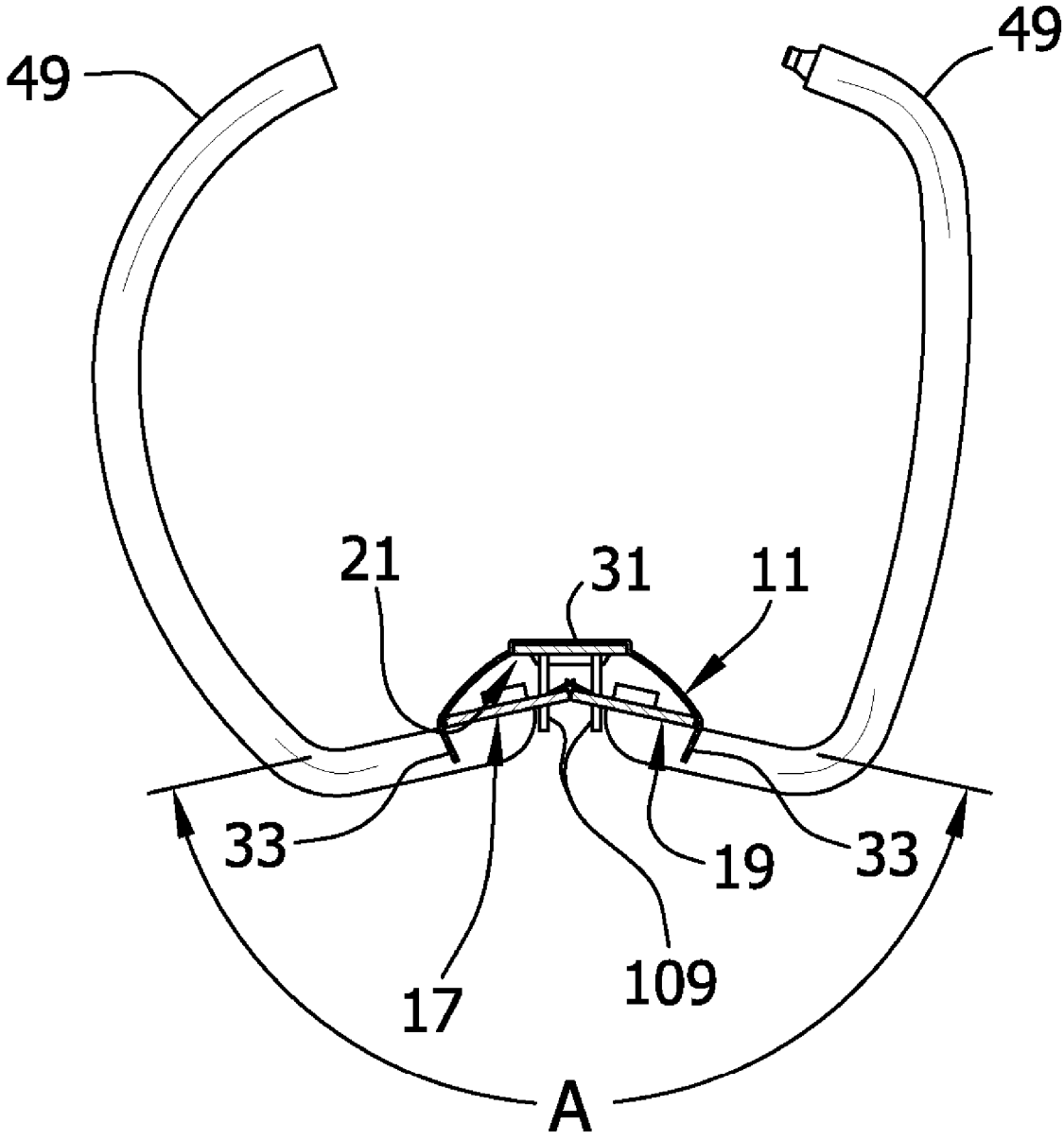
FIG. 3B is a section taken on line 3B-3B of FIG. 3A.
Figure 4:
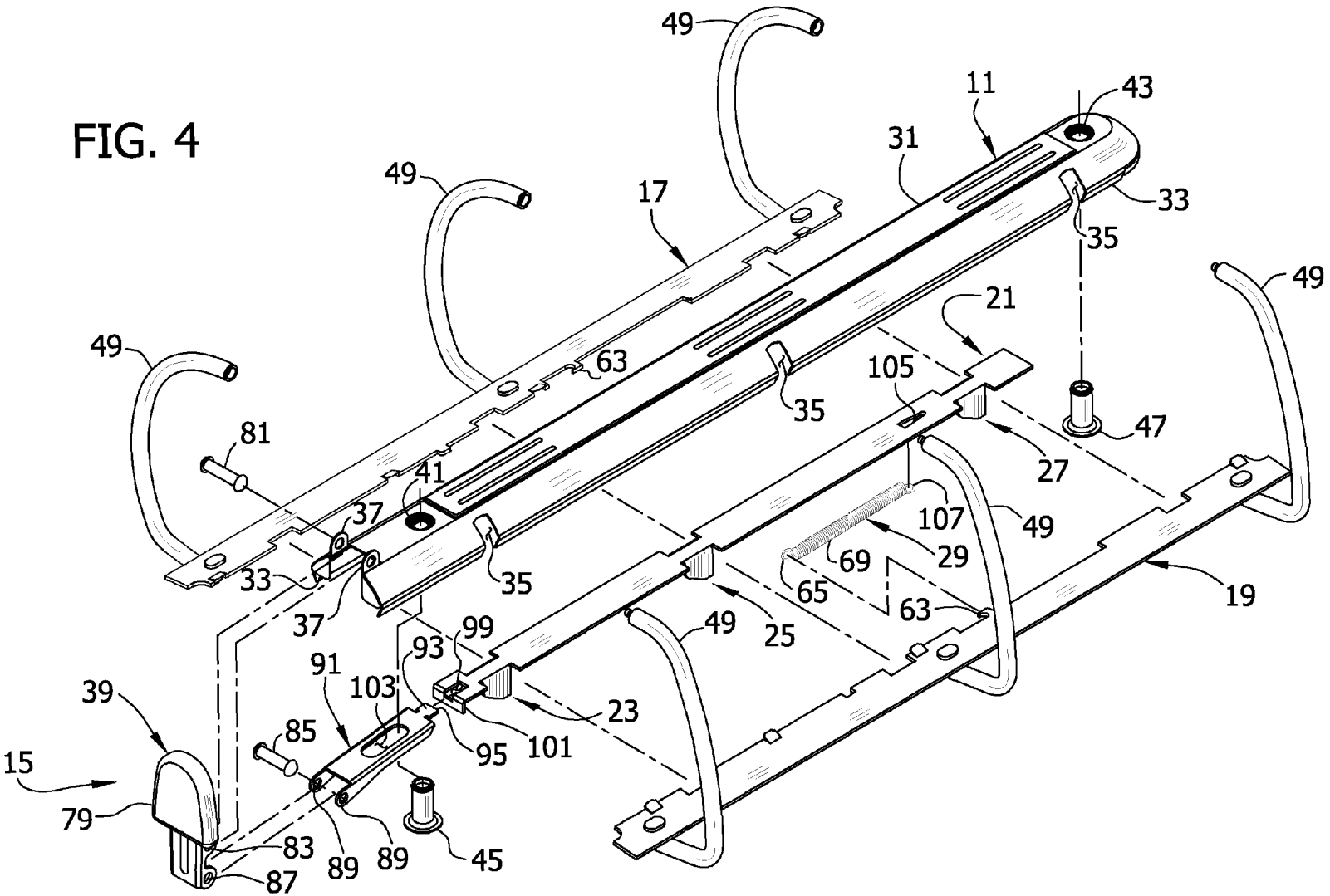
FIG. 4 is an exploded perspective of the mechanism.

Referring now to the drawings of the present invention, FIG. 1 shows a ring binder mechanism of the present invention according to a first embodiment capable of retaining loose-leaf pages (not shown). The mechanism is generally designated by reference numeral 1 and is shown mounted on a spine 3 of a notebook having a front cover 7 and a back cover 9 hingedly attached to the spine 3. The front and back covers 7, 9 move to selectively cover or expose retained pages. Ring binder mechanisms mounted on surfaces other than a notebook, however, do not depart from the scope of this invention. The mechanism 1 generally includes a housing 11, three rings (each generally indicated at 13), and a control structure (generally indicated at 15). The housing 11 supports both the rings 13 and the control structure 15 for either closing the mechanism 1 to retain pages on the rings 13 (FIGS. 2A and 2B) or opening it to load pages on the rings 13 (FIGS. 3A and 3B). As will be described hereinafter, the control structure 15 can either directly close and lock the mechanism 1 or it can allow a spring force of the housing 11 to open the mechanism 1. Referring to FIG. 4, the mechanism 1 includes a pair of hinge plates 17, 19 that pivot relative to the housing 11 for opening and closing the rings 13. The control structure 15 includes an actuating lever 39, a travel bar 21, and three locking elements 23, 25, 27 that interact with the hinge plates 17, 19 to either close and lock the rings 13 or allow them to open. In addition, the mechanism 1 includes a tension spring 29 located within the housing 11 for automatically moving the travel bar 21 and locking elements 23, 25, 27 to close and lock the rings 13.

The housing 11 shown in FIG. 4 is elongate and has a symmetrically, roughly arch-shaped cross section with a raised plateau 31 at its center. The housing 11 is made of metal, but may be also made of other suitable material that is sufficiently rigid to provide a stable mount for other components of the mechanism 1 while being sufficiently resilient to function as a spring. The housing 11 has a longitudinal axis, two transversely opposite longitudinally extending edge margins, and two longitudinal ends. A bent under rim 33 formed along both longitudinal edge margins of the housing 11 includes six total slots 35 (only three of which are visible) arranged in three transversely opposed pairs along the length of the housing for receiving the rings 13 (FIG. 2A). At one housing end, two tabs 37 project upward for attaching the actuating lever 39. The opposite housing end does not have a lever, although it is understood that a mechanism with a lever at each end of the housing does not depart from the scope of this invention. The raised plateau 31 includes two openings 41, 43, or eyelets, for receiving and attaching mounting posts 45, 47 capable of securing the mechanism 1 to the notebook 5. Differently shaped housings, including asymmetrical ones, and housings with different numbers of openings or slots do not depart from the scope of this invention.

The housing 11 loosely supports the two hinge plates 17, 19 for pivoting motion to either close the rings 13 (FIGS. 2A and 2B) or open the rings 13 (FIGS. 3A and 3B). Each ring 13 includes two ring members 49 mounted on adjacent hinge plates 17, 19 and movable therewith between a closed position and an open position. The ring members 49 are generally circular in cross section and are formed of suitable material such as steel. When they are in the closed position, each ring member 49 forms a substantially continuous, closed, "D"-shaped ring or loop (FIGS. 2A and 2B) for retaining loose-leaf pages and for allowing those pages to move along the rings 13 from one ring member 49 to the other. And when they are in the open position, each forms a discontinuous, open loop (FIGS. 3A and 3B) suitable for adding or removing pages. Although in the illustrated embodiment both ring members 49 can move, a mechanism having one movable ring member and one fixed does not depart from the scope of this invention. Additionally, a mechanism with more or less than three rings, or with rings that form different shapes when closed, does not depart from the scope of this invention.

Figure 5:
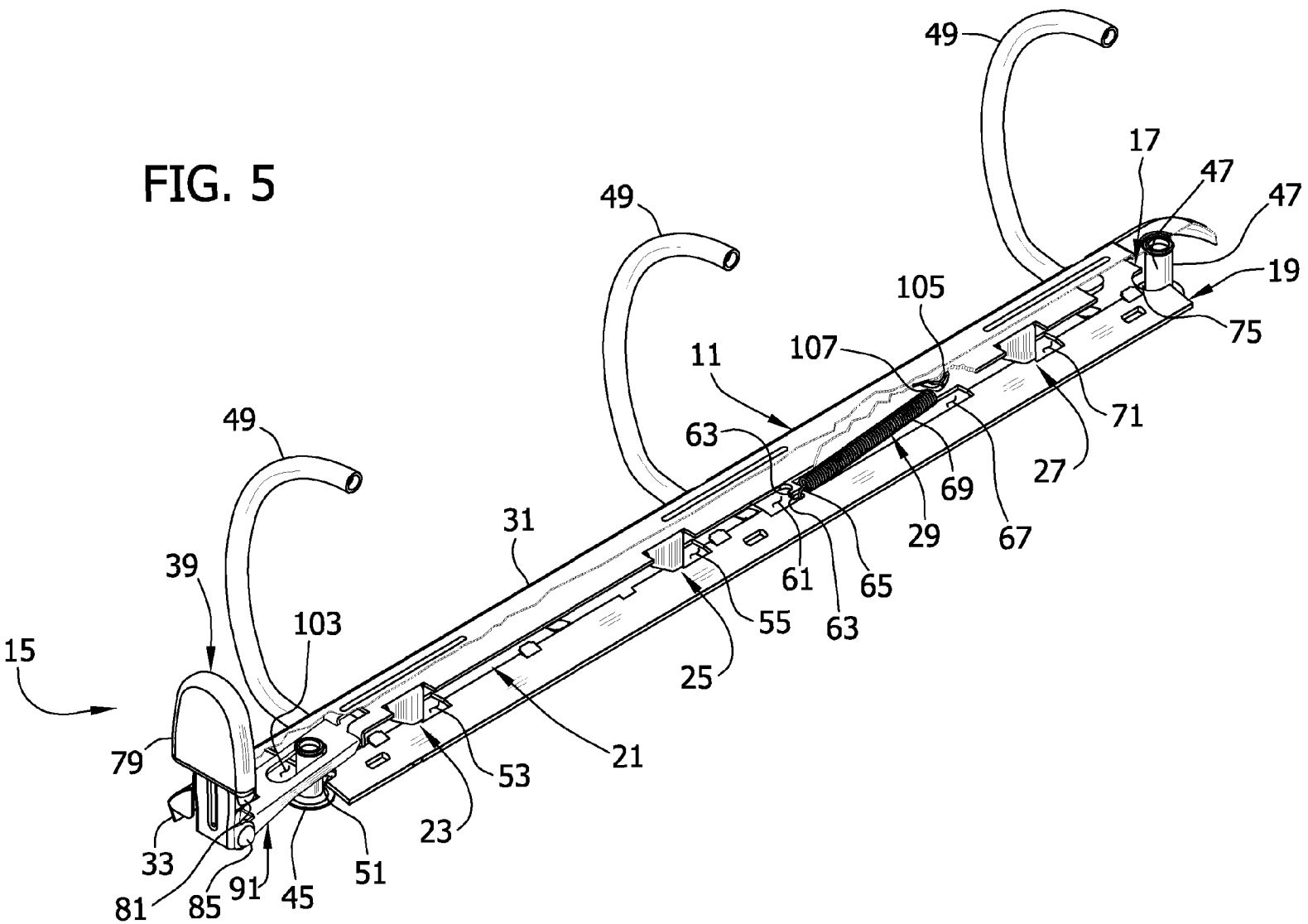
FIG. 5 is a perspective similar to FIG. 2A with a portion of a housing, a travel bar, and ring members broken away.

Still referring to FIG. 4, each hinge plate 17, 19 is a thin, elongate sheet having inner and outer longitudinal edge margins, and two longitudinal ends. Each hinge plate 17, 19 includes seven cutouts along its inner longitudinal edge margin so that when the hinge plates 17, 19 interconnect, corresponding cutouts in each plate 17, 19 align to form openings, as shown in FIG. 5. A first opening 51 is located near the housing end having the lever 39 and receives a first mounting post 45 through the hinge plates 17, 19. Second and third openings 53, 55 receive first and second locking elements 23, 25 respectively, as will be further discussed hereinafter. A fourth opening 61 includes two notches 63, with one notch 63 on each hinge plate 17, 19. Both notches 63 are capable of receiving a second end 65 of the tension spring 29. A fifth opening 67 accommodates a portion of a body 69 of the tension spring 29. A sixth opening 71 receives a third locking element 27 in identical fashion to the second and third openings 53, 55. A seventh opening 75 is located near the housing end not having the lever 39 and receives a second mounting post 47 through the hinge plates 17, 19.

The interconnected hinge plates 17, 19 attach to one another in parallel arrangement along their adjoining inner longitudinal edge margins, forming a central hinge having a pivot axis. The housing 11 receives the attached plates 17, 19 such that each plates' outer longitudinal edge margin loosely fits above the housing's corresponding bent under rim 33. Accordingly, the hinge plates 17, 19 are retained on the housing 11 but the edge margins are free to move within the rims 33, allowing the plates 17, 19 to freely pivot about their pivot axis. The pivot axis moves up (i.e., toward the housing's raised plateau 31 as shown in FIG. 3B) when the hinge plates 17, 19 pivot to open the rings 13 and it moves down (i.e., away from the housing's raised plateau 31) when the plates 17, 19 pivot to close the rings 13. Moreover, the hinge plates 17, 19 are designed to pivot in the housing 11 so that an angle A (FIGS. 2B and 3B) between exterior surfaces of the plates (i.e., the surfaces facing away from the housing 11) is always less than 180° and the pivot axis never moves to or below a coplanar position of the plates 17, 19 (i.e., the position where the angle A is 180°). Accordingly, the housing's spring force biases the hinge plates 17, 19 to pivot only for opening the ring members 49. It does not bias the plates 17, 19 to pivot for closing the ring members 49. It is to be understood, however, that in some embodiments an angle between exterior surfaces could be greater than 180° so that a spring force of a housing biases hinge plates toward a closed position. Furthermore, certain embodiments of the present invention may have hinge plates arranged to pass through a coplanar position (180°) of the hinge plates.

As stated previously, the housing 11 supports the control structure 15 for moving relative to the housing 11 to controllably pivot the hinge plates 17, 19 and securely lock the ring members 49 closed. The actuating lever 39 of the control structure, shown in FIGS. 4 and 5, is formed from a suitable rigid material or combination of materials, such as a metal or a plastic. It includes an enlarged head 79 to facilitate gripping and applying force to the lever 39. A first hinge pin 81 received through upper openings 83 in the lever 39 and through the housing's tabs 37 mounts the lever 39 on the housing 11 for pivoting relative to the housing 11. A second hinge pin 85 received through lower openings 87 in the lever 39 and through openings 89 in an intermediate connector 91 attaches the lever 39 to the connector 91. The intermediate connector 91 connects the lever 39 to the travel bar 21 for transforming the lever's pivoting movement into substantially linear travel bar movement. Although the travel bar's movement is not perfectly linear, it is still considered to be translational motion for purposes of the present invention.

Referring to FIG. 4, the intermediate connector 91 is generally an elongate beam with a flat web and two side flanges. It includes a first end that is generally wider than a second end. More specifically, at the narrower second end the intermediate connector 91 includes a projecting tab 93 with an enlarged end 95 that is received in a slot 99 in a first end of the travel bar 21. This travel bar end is also bent down to form a shoulder 101 against one side of which the intermediate connector 91 can bear to push the travel bar 21. The enlarged end 95 of the projecting tab 93 is engageable with the other side of the shoulder 101 to pull the travel bar 21 toward the lever 39. The slot 99 in which the tab 93 is received is elongate in the lengthwise direction of the travel bar 21. Thus, the intermediate connector 91 is able to freely pivot up and down with respect to the travel bar 21. As a result, the connector 91 transmits a linear movement to the travel bar 21 from the pivoting lever 39. Moreover, the travel bar 21 is allowed to move up and down without hindrance from the intermediate connector 91. The illustrated connector 91 also includes an elongate opening 103 for receiving the first mounting post 45 through the connector 91 and allowing the connector 91 to move relative to the mounting post 45.

Figure 6:
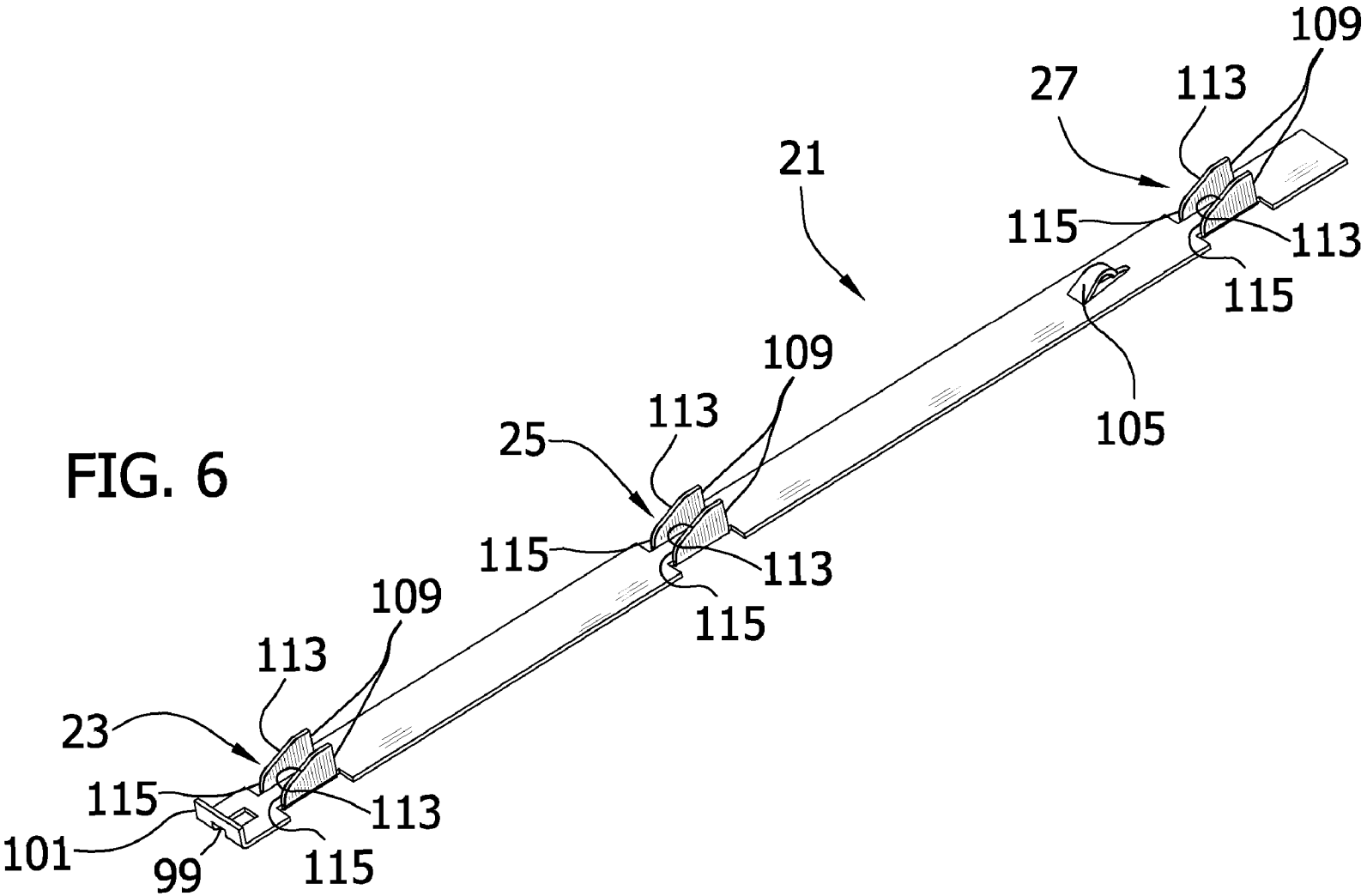
FIG. 6 is a bottom perspective of the travel bar of the first embodiment.

As shown in FIGS. 4-6, the travel bar 21 is capable of receiving the lever's pivoting motion for movement generally lengthwise of the housing 11. The travel bar 21 is a relatively flat, elongate sheet made of a metal or other sufficiently rigid material. It is disposed generally parallel to the longitudinal axis of the housing, under the raised plateau 31 and above the hinge plates 17, 19. A detent 105 is located along the travel bar's longitudinal axis and toward a second end. The detent 105 is one piece with the travel bar 21 and is struck downward from the bar's surface, forming a hook for attaching a first end 107 of the tension spring. It is understood that differently shaped travel bars, or travel bars having a detent separately attached do not depart from the scope of this invention.

The travel bar 21 also includes the three integral locking elements 23, 25, 27 that can either (1) cause the hinge plates 17, 19 to pivot for closing the ring members 49 and block the hinge plates' pivoting motion for locking the ring members 49 closed or (2) allow the hinge plates 17, 19 to pivot for opening the ring members 49 (i.e., they can register with respective hinge plate openings 53, 55, 71, allowing the housing's spring force to pivot the hinge plates 17, 19 to open the ring members 49). The locking elements 23, 25, 27 of the illustrated embodiment each comprise two spaced apart flanges 109 formed as one piece with the travel bar 21 and folded downward 90° from a longitudinal edge margin of the travel bar (FIG. 6). Accordingly, each flange's planar surface is substantially parallel to that of every other flange and is aligned with the travel bar's longitudinal axis. In addition, a lower edge portion of each flange is angled, forming a cam surface 113 capable of engaging the hinge plates 17, 19 and causing them to pivot. It will be understood that locking elements may be formed as a single piece or as more than two pieces, and that control structures using more or fewer than three locking elements, or differently shaped locking elements do not depart from the scope of this invention.

The travel bar 21 and three locking elements 23, 25, 27 are biased to a locking position blocking the hinge plates' pivoting motion by the tension spring 29. The tension spring 29 automatically pulls the travel bar 21 and locking elements 23, 25, 27 to the locking position when the locking elements 23, 25, 27 move out of registration with respective openings 53, 55, 71 in the hinge plates 17, 19. The tension spring 29 is located generally between the travel bar 21 and the hinge plates 17, 19, and is partially received in the hinge plates' fifth opening 67. A tension spring is desired for such biasing action because it offers a variety of placement options within a ring binder mechanism since its axis does not need to align with a travel bar's direction of movement to cause the travel bar and locking elements to move to a locking position.

Figure 7:
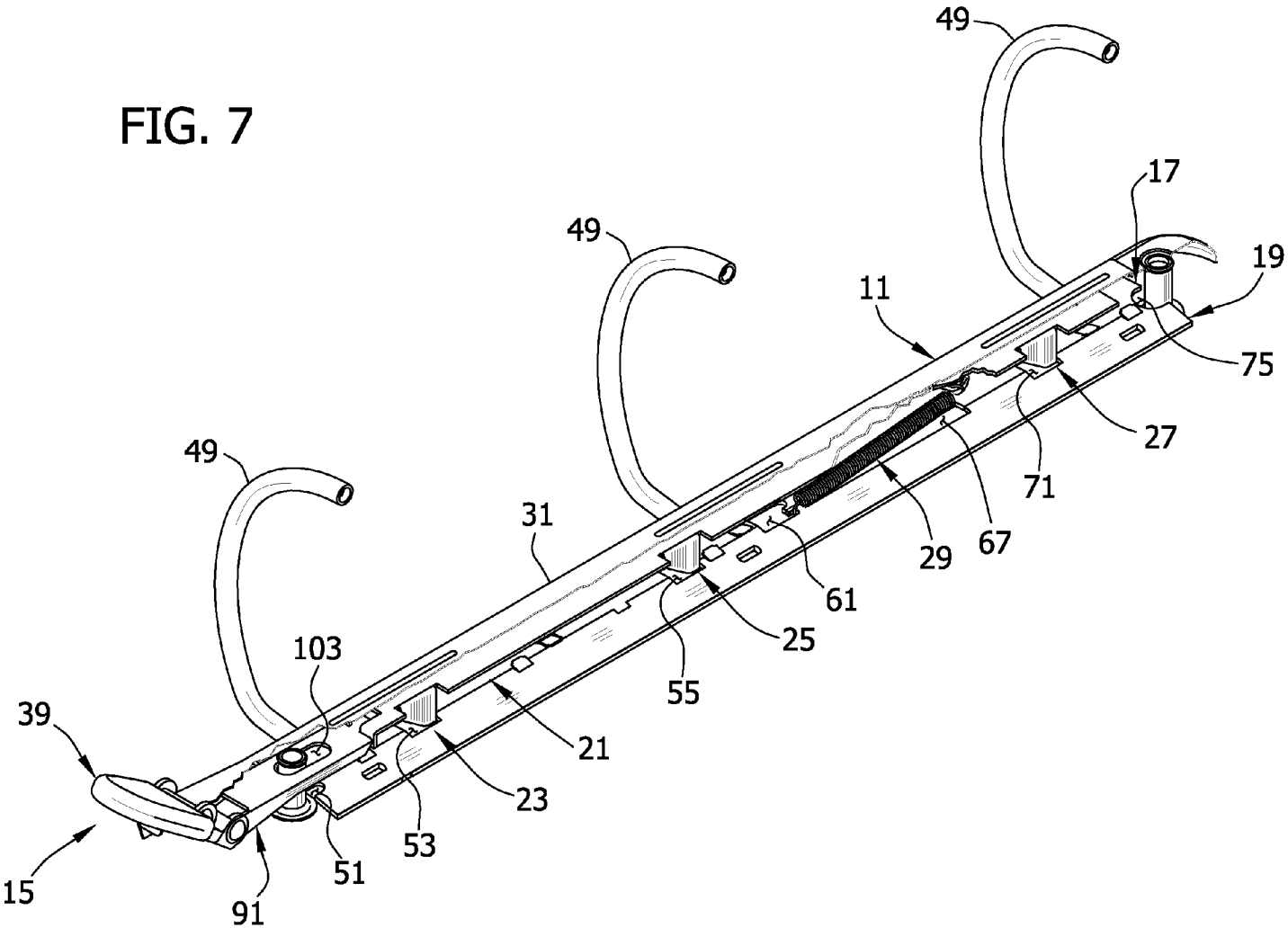
FIG. 7 is the perspective of FIG. 5 with the mechanism at an intermediate transitional position between the open position and the closed and locked position.
Figure 8:
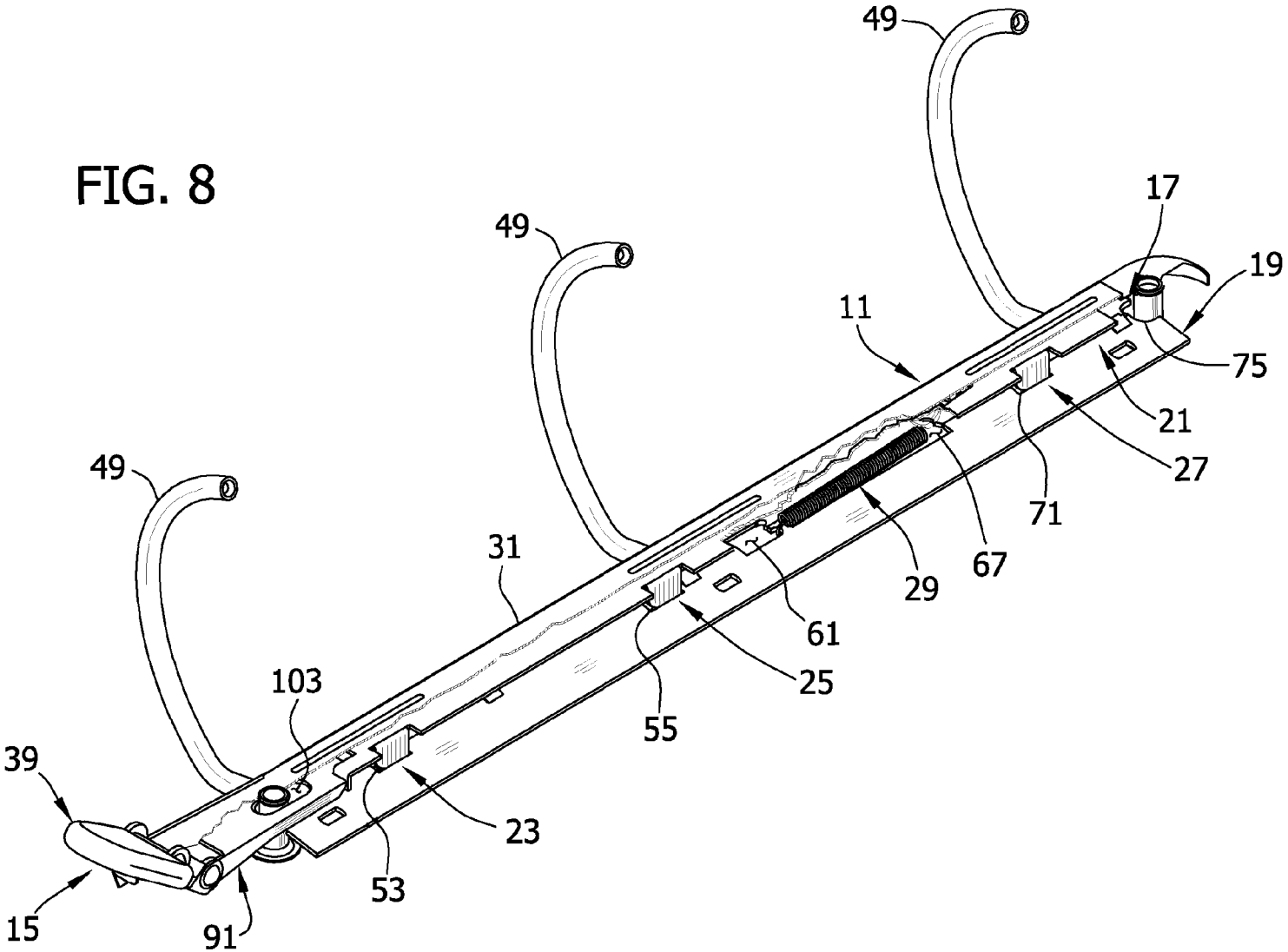
FIG. 8 is the perspective of FIG. 5 with the mechanism at the open position.

Now referring to FIGS. 5, 7, and 8, the control structure 15 can selectively move the mechanism 1 between a closed and locked position (FIG. 5) and an open position (FIG. 8). At the closed and locked position, the ring members 49 are together and cannot be pulled apart. The hinge plates 17, 19 are oriented so that the angle A between their exterior surfaces is at its greatest, but still less than 180° (FIG. 2B) and the actuating lever 39 is relatively vertical with the travel bar 21 positioned closer to the housing end having the lever 39. Accordingly, the first, second, and third locking elements 23, 25, 27 are located between the hinge plates 17, 19 and the housing 11, and are substantially out of registration with the respective hinge plate openings 53, 55, 71. In this position, the locking elements 23, 25, 27 firmly oppose any force tending to open the ring members 49 because they are sized, along with the travel bar 21, to fully occupy the area between the hinge plates 17, 19 and the housing's raised plateau 31. So as the hinge plates 17, 19 push up on the locking elements 23, 25, 27 (i.e., such as when the hinge plates 17, 19 pivot to open the ring members 49) they immediately engage the locking elements 23, 25, 27 and tend to force both the locking elements 23, 25, 27 and the travel bar 21 up. Thus, the locking elements 23, 25, 27 and the housing 11 resist the opening movement, holding the ring members 49 together.

To open the mechanism 1, an operator pivots the lever 39 outward and downward (FIG. 7). This pushes the intermediate connector 91 and travel bar 21 away from the housing end having the lever 39, and moves the travel bar 21 and locking elements 23, 25, 27 out of the locking position. As the travel bar 21 and locking elements 23, 25, 27 move, the tension spring 29 extends and begins to exert a steadily increasing force, urging them back toward the locking position. But as long as the operator continues pivoting the lever 39, the travel bar 21 and locking elements 23, 25, 27 continue to move until the three locking elements 23, 25, 27 simultaneously move into registration with the respective second, third, and sixth openings 53, 55, 71 in the hinge plates. At this intermediate transitional position, the locking elements 23, 25, 27 no longer block the hinge plates' pivoting motion and the housing's spring force automatically pivots the hinge plates 17, 19. The three corresponding openings 53, 55, 71 of the hinge plates pass over the locking elements 23, 25, 27 and the ring members 49 open (FIG. 8). Here, the angle A between the hinge plates' exterior surfaces is at its smallest (FIG. 3B) and a substantially vertical portion 115 (see FIG. 6) of each locking element's cam surface contacts an edge of the respective opening 53, 55, 71 in the hinge plates. This blocks the locking elements 23, 25, 27 and prevents contraction of the tension spring 29 that would move the travel bar 21 back to the locking position. Moreover, the housing's spring force holds the ring members 49 open so that the operator may let go of the lever 39 and load or remove pages from the mechanism 1.

To return the mechanism 1 back to the closed and locked position, the operator pivots the lever 39 inward and upward, reversing the opening action and pulling the intermediate connector 91 and travel bar 21 back toward the housing end having the lever 39. This causes the locking elements' cam surfaces 113 to engage the edges of the respective openings in the hinge plates 17, 19 and overcome the forces (i.e., a friction force between the locking elements' cam surfaces 113 and the hinge plates 17, 19 and the spring force of the housing 11) opposing the hinge plates' opening motion. Thus, the hinge plates 17, 19 slowly slide down each cam surface 113 and gently move the ring members 49 together. Once the ring members 49 fully close and the angle A between the hinge plates' exterior surfaces is again at its greatest (FIG. 2B), the cam surfaces 113 disengage the edges of the openings and the tension spring 29 contracts, automatically pulling the travel bar 21 and locking elements 23, 25, 27 back to the locking position. The locking elements 23, 25, 27 fully return to their position behind the hinge plates 17, 19, blocking the plates' pivoting motion. The mechanism 1 may alternatively be returned to the closed and locked position by simply pushing the ring members 49 together. This pivots the hinge plates 17, 19 and moves the openings 53, 55, 71 therein to a position below the locking elements 23, 25, 27, allowing the tension spring 29 to contract and pull the travel bar 21 and locking elements 23, 25, 27 back to the locking position.

The ring binder mechanism of the present invention effectively retains loose-leaf pages when the ring members 49 are closed, and readily prevents the closed ring members 49 from unintentionally opening. This is because the tension spring 29 automatically positions the travel bar 21 and the locking elements 23, 25, 27 in the locking position when the ring members 49 close, eliminating additional manual movement of the lever to lock the mechanism 1. This locking characteristic exists regardless of how the mechanism 1 is closed (i.e., regardless of whether the ring members 49 are directly pushed together or whether the lever 39 is pivoted). Moreover in this embodiment, the ring members 49 do not snap together when they close because the locking elements' cam surfaces 113 controllably wedge the hinge plates 17, 19 and gently close the ring members 49. Also, when the mechanism 1 is closed it distributes force generally uniformly to the ring members 49 because the three locking elements 23, 25, 27 are uniformly spaced along the length of the hinge plates 17, 19. Additionally, the locking elements 23, 25, 27 and travel bar 21 generally completely occupy the area between the hinge plates 17, 19 and the housing's raised plateau 31, fully resisting hinge plate movement that would open the ring members 49. As a result, the ring members are positively locked together and gaps between the ring members 49 are minimized, if not eliminated. Furthermore, this mechanism 1 opens easier than prior art mechanisms because the operator need only stretch the tension spring 29 a short distance before the locking elements 23, 25, 27 register with respective openings 53, 55, 71 in the hinge plates 17, 19, allowing the housing's spring force to automatically pivot the hinge plates 17, 19 to open the ring members 49. Similarly, the lever's pivoting movement reduces the magnitude of force necessary to move the travel bar 21 and locking elements 23, 25, 27 to open (or close) the ring members 49 because of the mechanical advantage given by the lever 39. Levers that directly push or pull a travel bar, such as those associated with prior art mechanisms, must overcome additional internal friction forces before ultimately opening or closing ring members.

Figure 9:
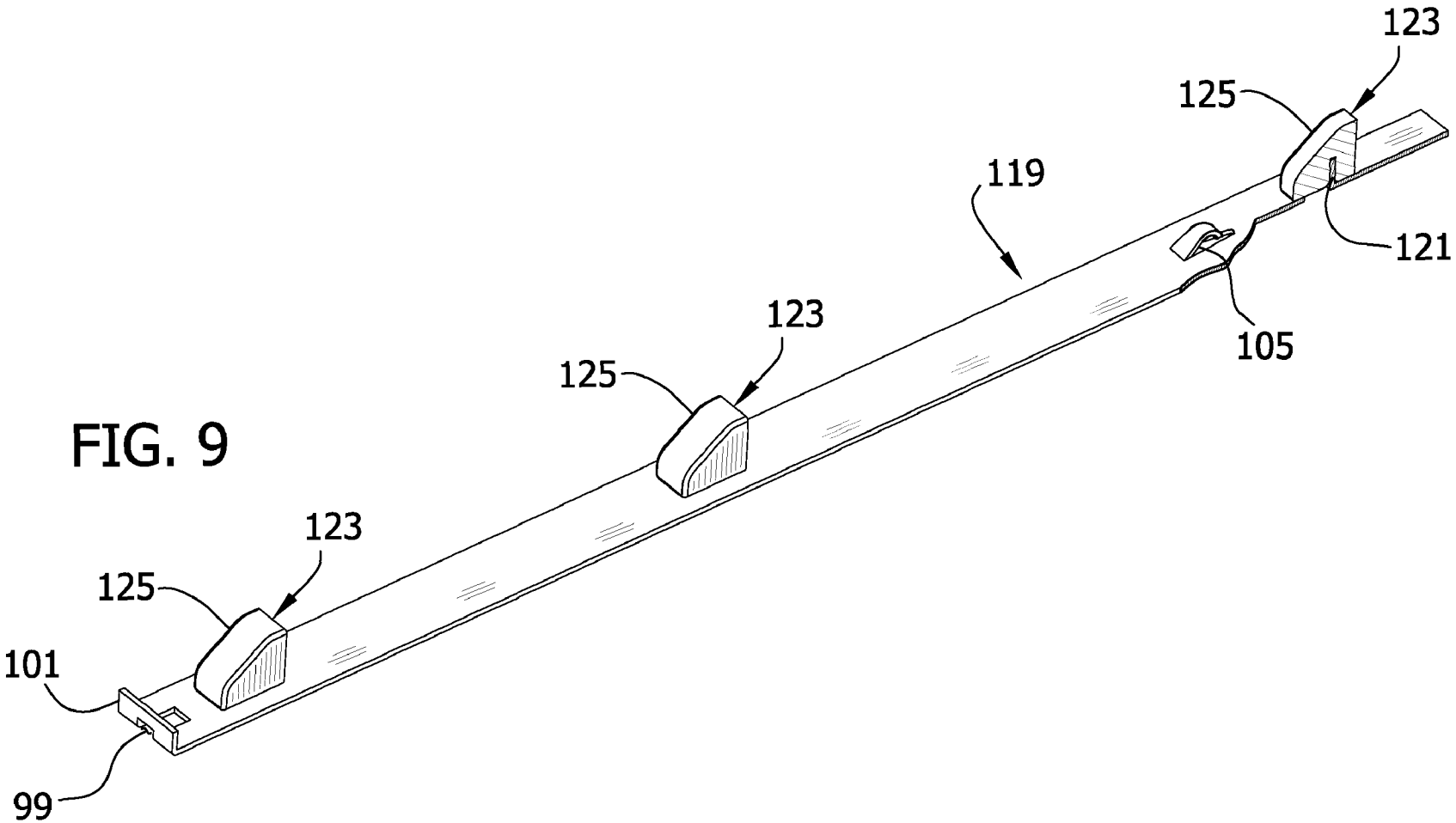
FIG. 9 is a bottom perspective of an alternative version of the travel bar with a portion of the travel bar and a portion of a locking element thereof broken away.

FIG. 9 illustrates an alternative version of a travel bar, generally designated by reference numeral 119. This travel bar includes three tabs 121 (only one of which is shown) formed as one piece with the travel bar 119. Each tab 121 is struck downward 90° from the bar's surface and receives a locking element 123 formed separately from the travel bar 119 and secured to the tab. The locking element 123 is generally block-shaped and may be made of plastic or other suitable material capable of resisting the hinge plates' pivoting motion and of wedging the hinge plates 17, 19 to move the ring members 49 together. The locking element 123 includes an angled cam surface 125 substantially similar to that of the locking element flanges 109 of the travel bar of the first embodiment. Consequently, each embodiment described herein may include this alternative travel bar 119.

FIGS. 10A-12 show a second embodiment of a ring binder mechanism of the present invention, substantially as described above and shown in FIGS. 1-8. The mechanism is generally indicated at 201, and parts of this mechanism corresponding to parts of the mechanism of the first embodiment are indicated by the same reference numerals, plus "200". This embodiment is similar to the first embodiment, but includes two wire form springs 327 attached to an underside of interconnected hinge plates 217, 219. The springs 327 urge the plates 217, 219 to pivot for opening ring members 249 when locking elements 223, 225, 227 register with respective openings 253, 255, 271 in the hinge plates 217, 219. Also in this embodiment, the hinge plates' pivot axis moves below a coplanar position (180°) of the hinge plates when the hinge plates 217, 219 pivot to close the ring members 249. Accordingly, the angle A made by the exterior surfaces of the hinge plates 17, 19 is greater than 180° in this position (FIG. 10B).

To receive the wire form springs 327, each hinge plate 217, 219 includes two notches 329 and one cutout 331 along its outer longitudinal edge margin (the notches 329 and cutout 331 are only visible on one hinge plate 219). The notches 329 are arranged in side-by-side fashion, defining a tab therebetween, and are located toward one end of the hinge plate; the cutout 331 is located toward the other end of the hinge plate. The tab and the cutout 331 are oriented in reverse order on the two hinge plates 217, 219 so that when the two plates 217, 219 interconnect, one plate's tab is across from the other plate's cutout 331.

Figure 10A:
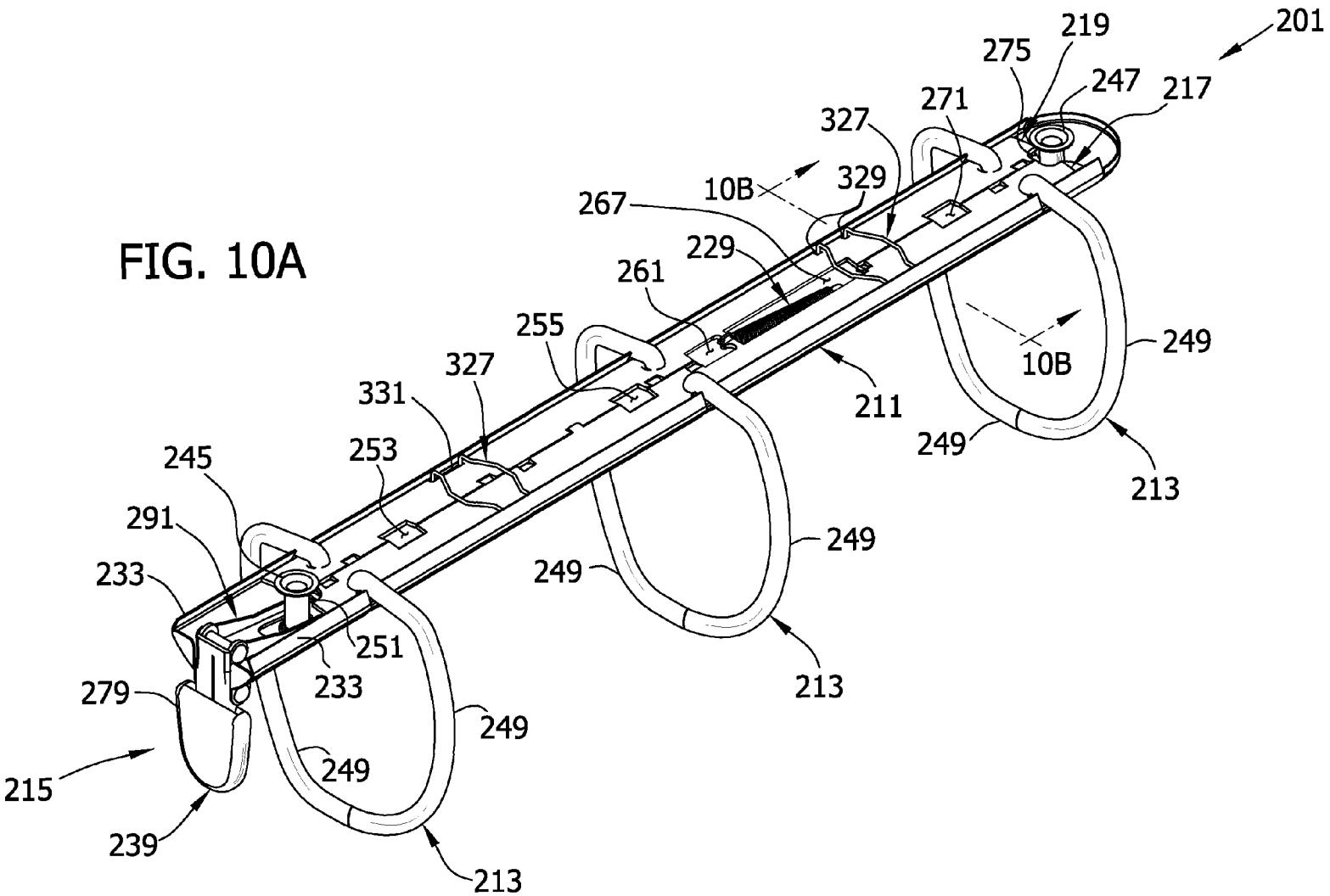
FIG. 10A is a bottom perspective of a second embodiment of a ring binder mechanism of the present invention at a closed position.
Figure 10B:
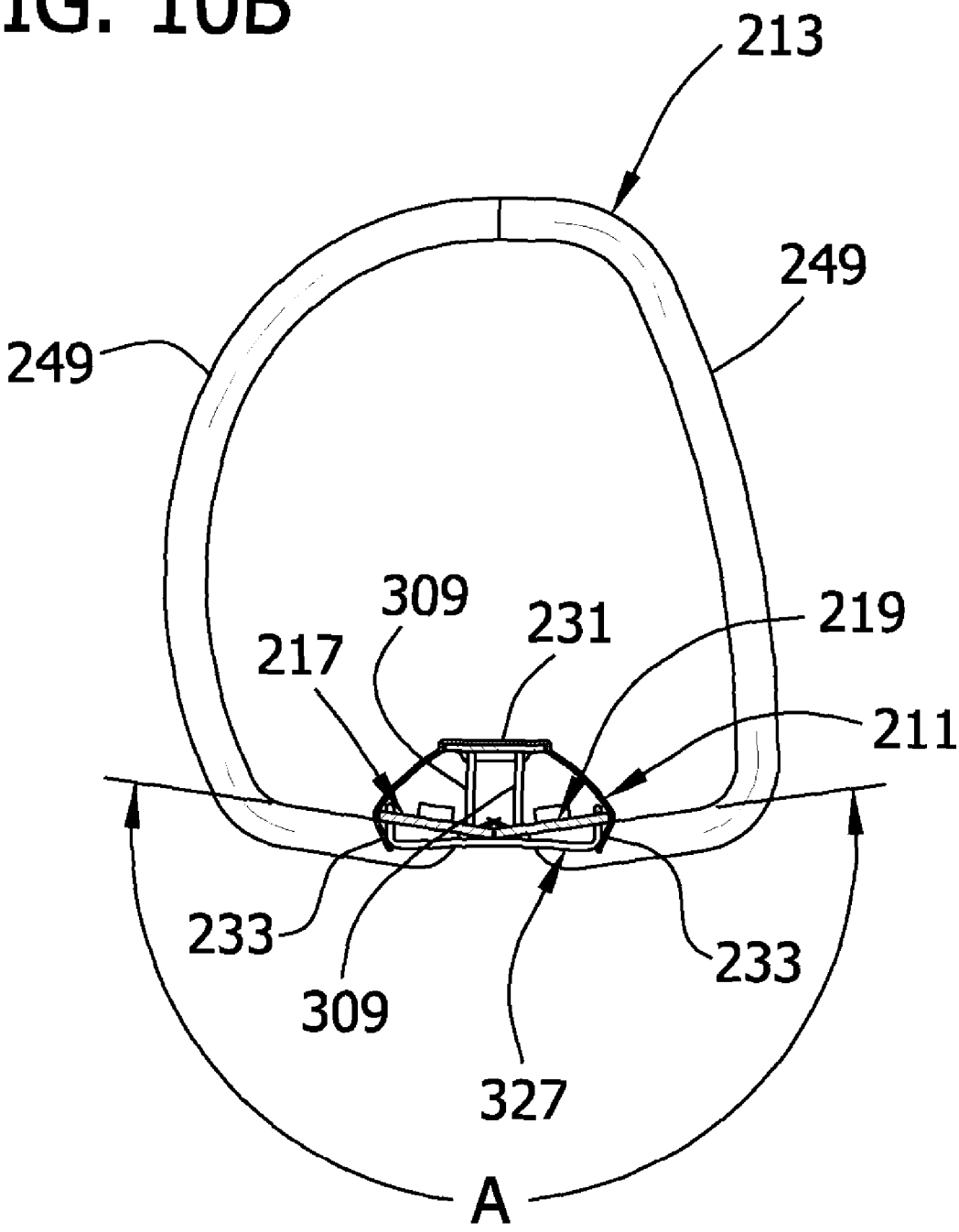
FIG. 10B is a section taken on line 10B-10B of FIG. 10A and inverted to an upright orientation.
Figure 11A:
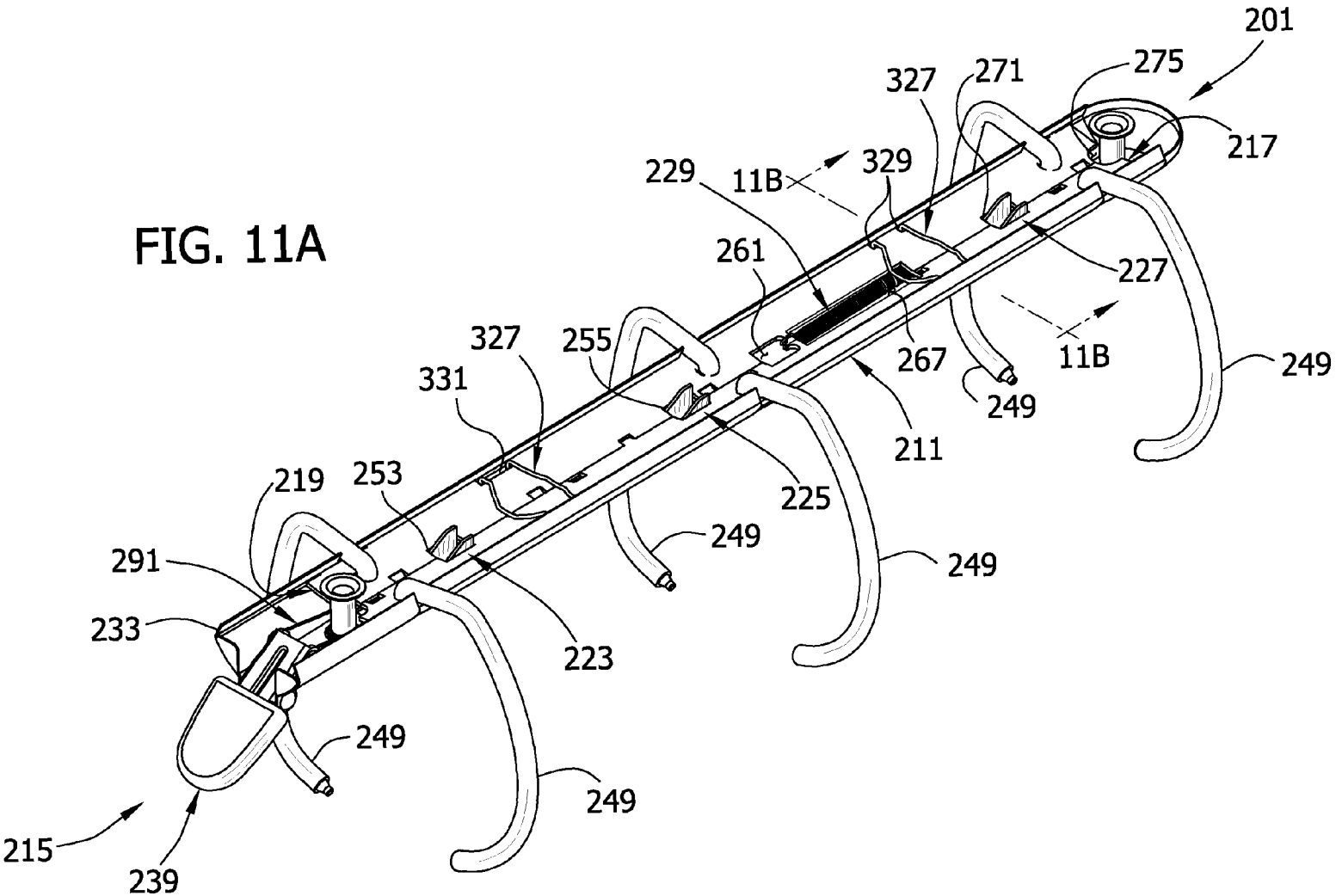
FIG. 11A is the perspective of FIG. 10A with the mechanism at an open position.
Figure 11B:
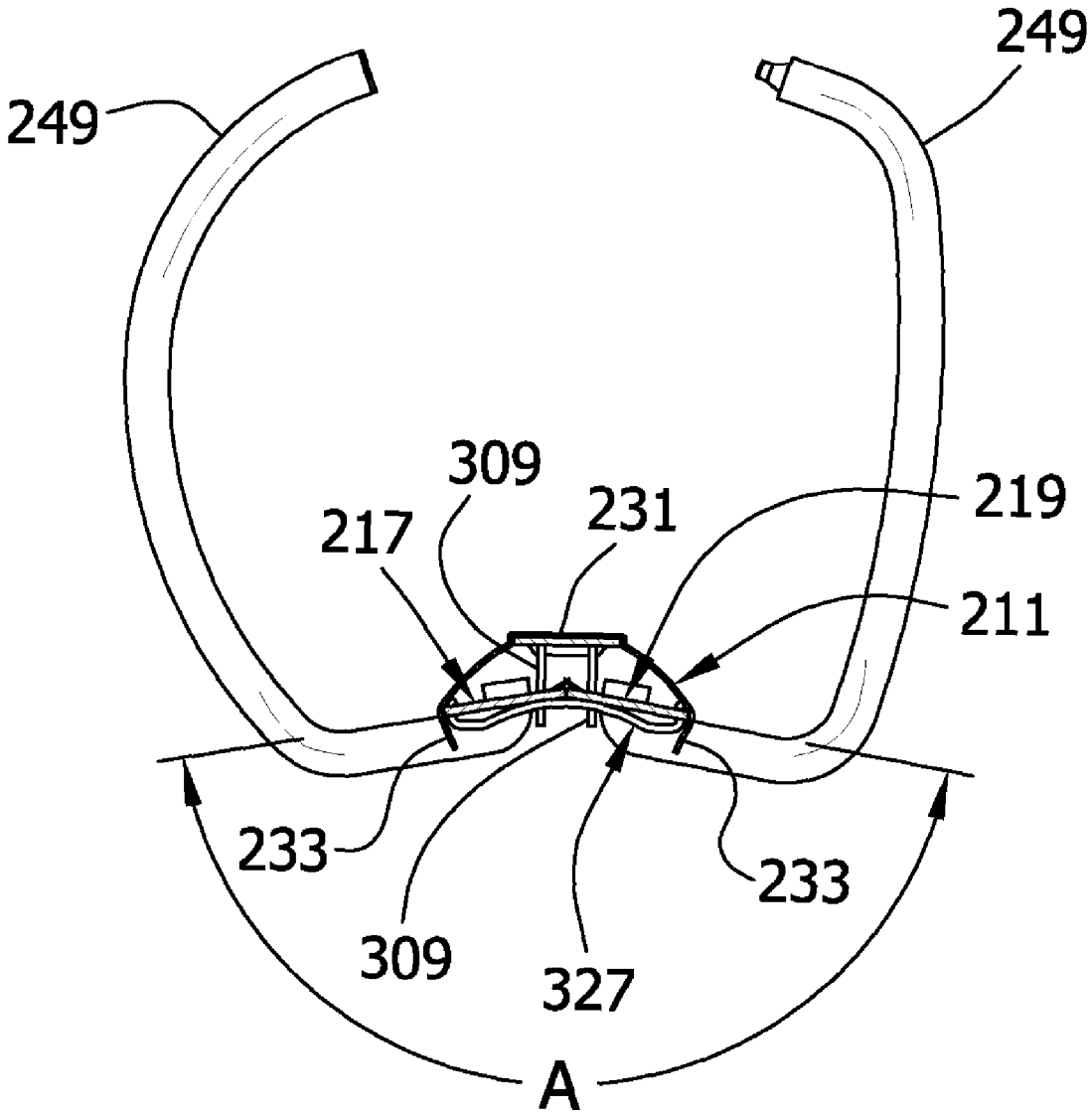
FIG. 11B is a section taken on line 11B-11B of FIG. 11A and inverted to an upright orientation.
Figure 12:
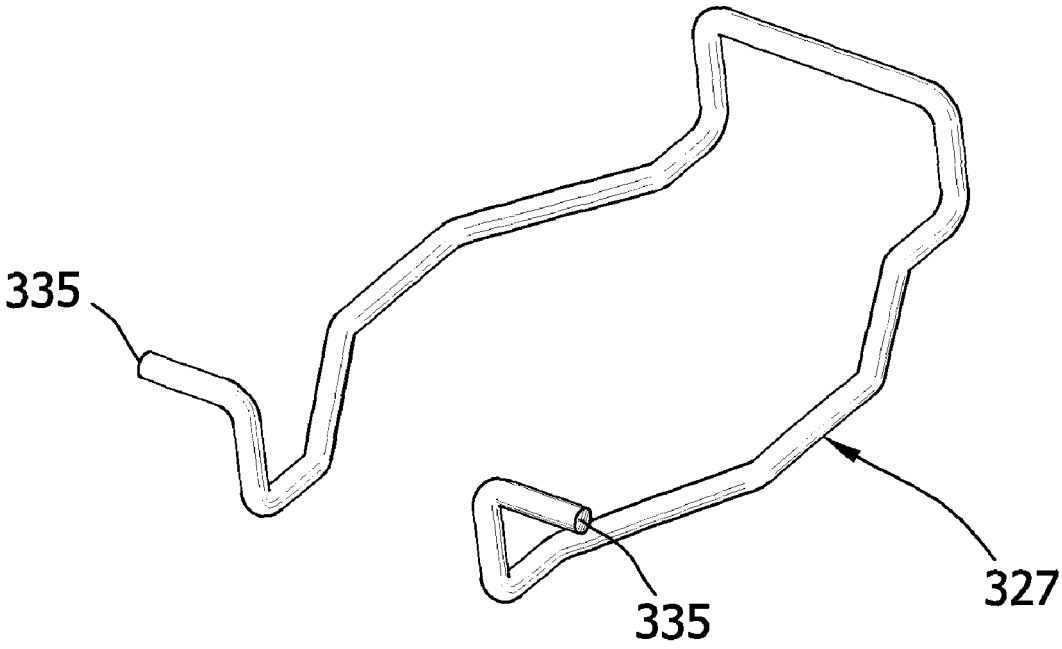
FIG. 12 is a perspective of a wire form spring of the second embodiment.

As shown in FIGS. 10A, 11A, and 12, the wire form spring 327 is a generally round wire formed roughly into an elongate octagon with an open end and a closed end (the open end forming one of the sides of the octagon). The closed end is bent upward 90° and fits over the tab and into the two notches 329 of one of the interconnected hinge plates 217, 219. The free end of the tab is received behind a rim 233 of a housing so that the closed end of the spring 327 is held on the tab. The open end of the spring 327 includes two wire tips 335 that are each bent twice into a hook shape. A first bend is 90° upward and a second bend is 90° outward. The tips 335 releasably fit into the cutout 331 of a second interconnected hinge plate 217, 219 so that a body of the attached wire form spring is positioned substantially underneath the interconnected plates 217, 219. In this attached position, the wire form springs 327 are relaxed when the hinge plates 217, 219 are oriented with the ring members 249 open. The body of the wire form spring 327 is bowed slightly upward (i.e., toward the interconnected plates 217, 219 (FIG. 11B)) so that exterior surfaces of the interconnected hinge plates form an angle A that is less than 180° (i.e., the hinge plates' pivot axis is above the coplanar position (180°) of the hinge plates 217, 219). When the locking elements 223, 225, 227 move the hinge plates 217, 219 down and through the coplanar position (180°) to close the ring members 249, each bowed wire form spring 327 flattens and stresses (FIG. 10B). When the locking elements 223, 225, 227 move back into registration with corresponding openings 253, 255, 271 in the hinge plates, the stressed wire form springs 327 automatically act on the hinge plates 217, 219 and pivot them up and through the coplanar position (180°), opening the ring members 249. Because the wire form springs 327 bias the hinge plates 217, 219 to open the ring members 249, the housing's spring force in this embodiment may be somewhat smaller than in typical prior art mechanisms, making it easier to close this mechanism 201. It is understood that while the illustrated mechanism 201 includes two wire form springs 327, mechanisms having fewer than two or more than two wire form springs do not depart from the scope of this invention.

Figure 13:
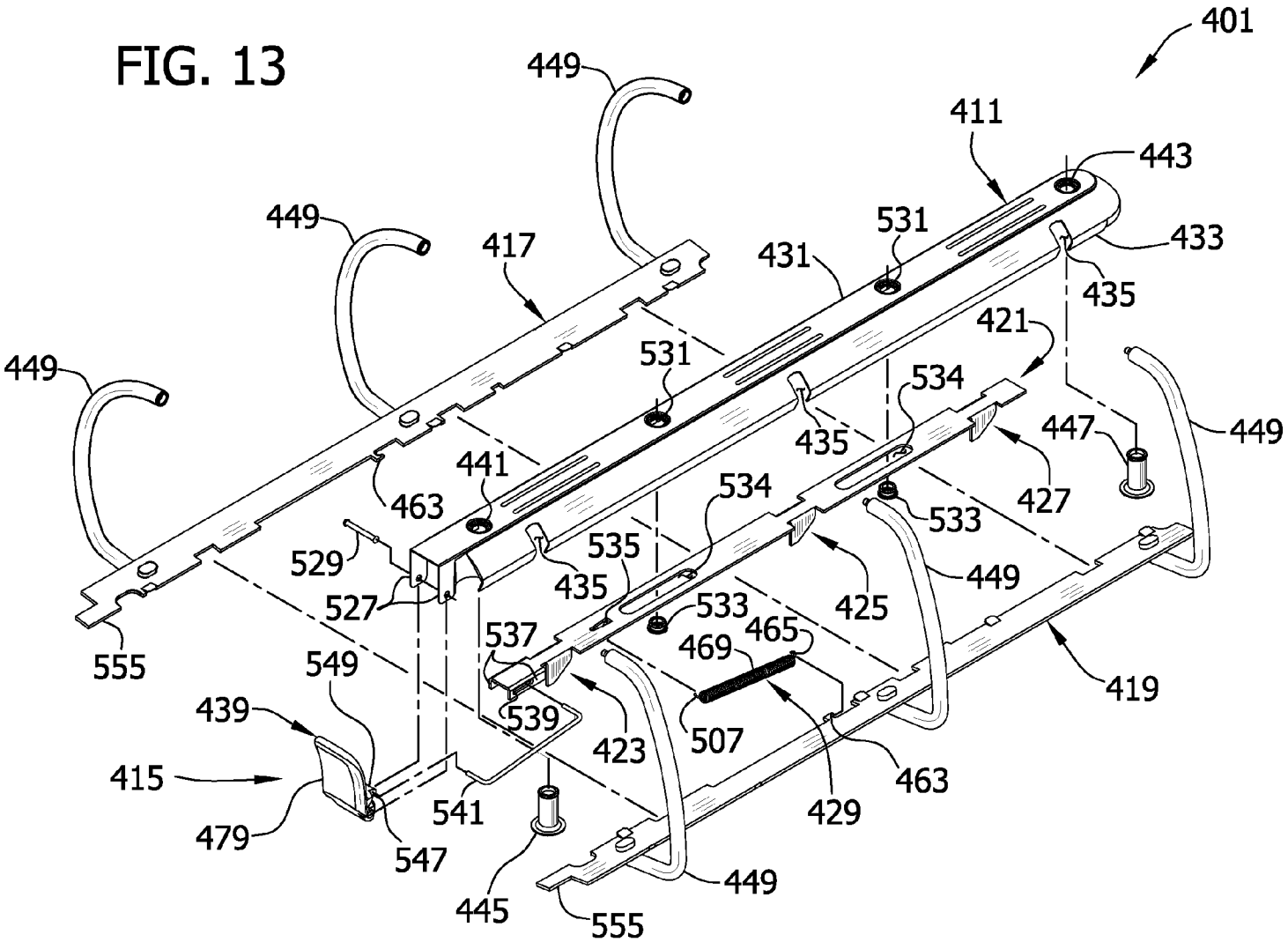
FIG. 13 is an exploded perspective of a ring binder mechanism of the present invention according to a third embodiment.
Figure 14:
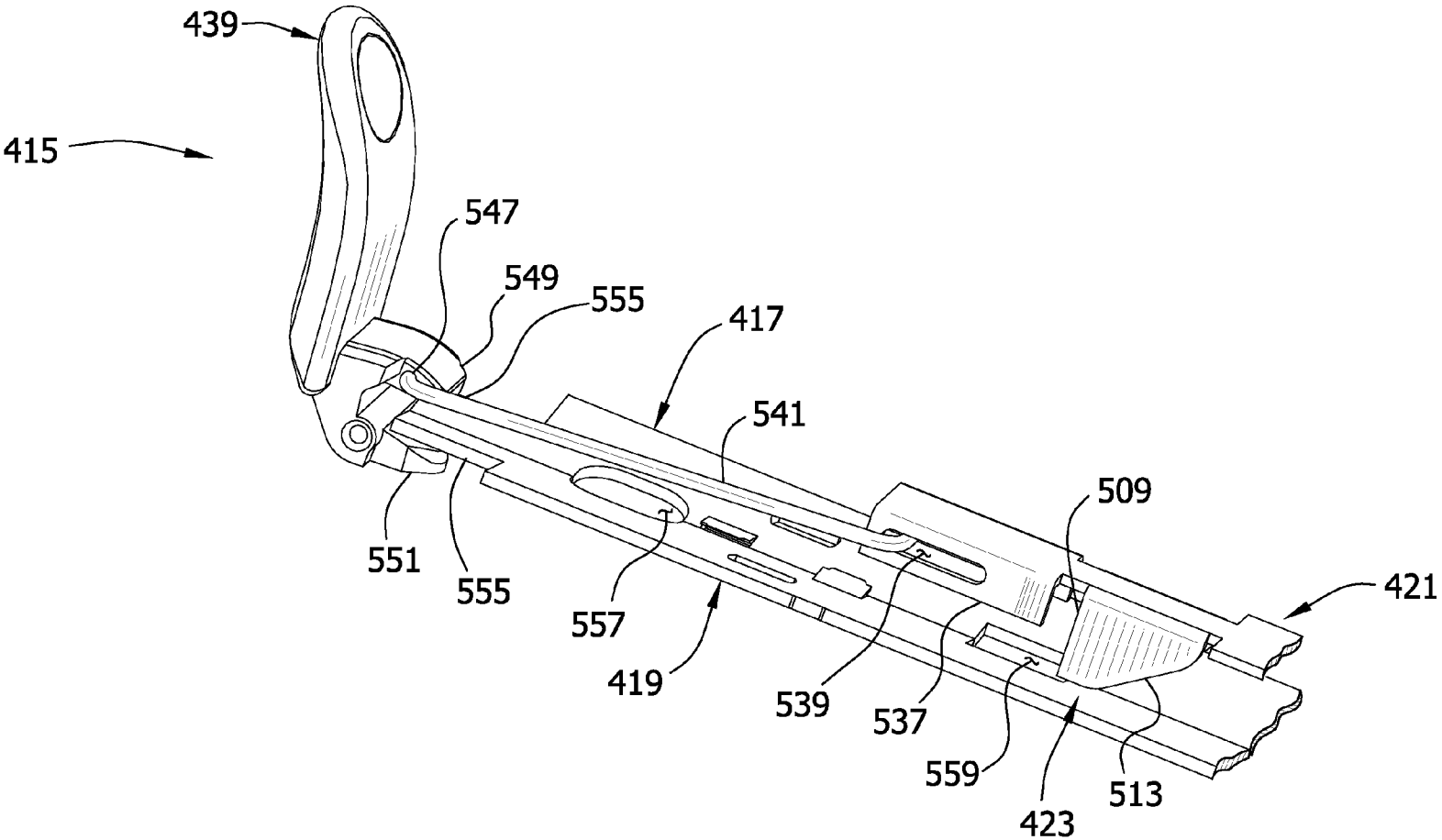
FIG. 14 is a fragmentary perspective of the mechanism of FIG. 13 in a closed and locked position with a housing, a mounting post, and ring members removed.
Figure 15A:
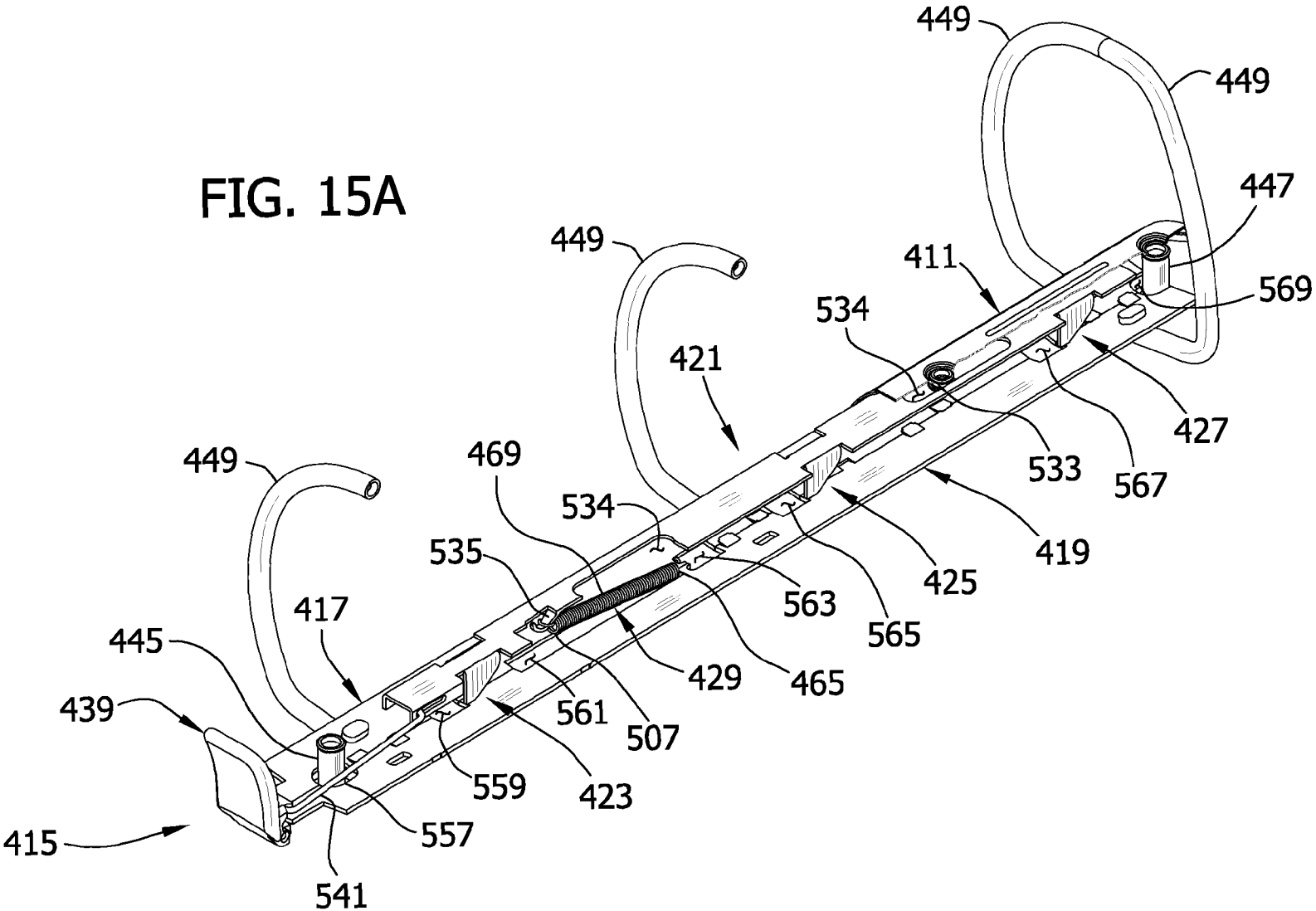
FIG. 15A is a perspective of the mechanism of FIG. 13 at a closed and locked position with a portion of a housing, a travel bar, and ring members broken away.
Figure 15B:
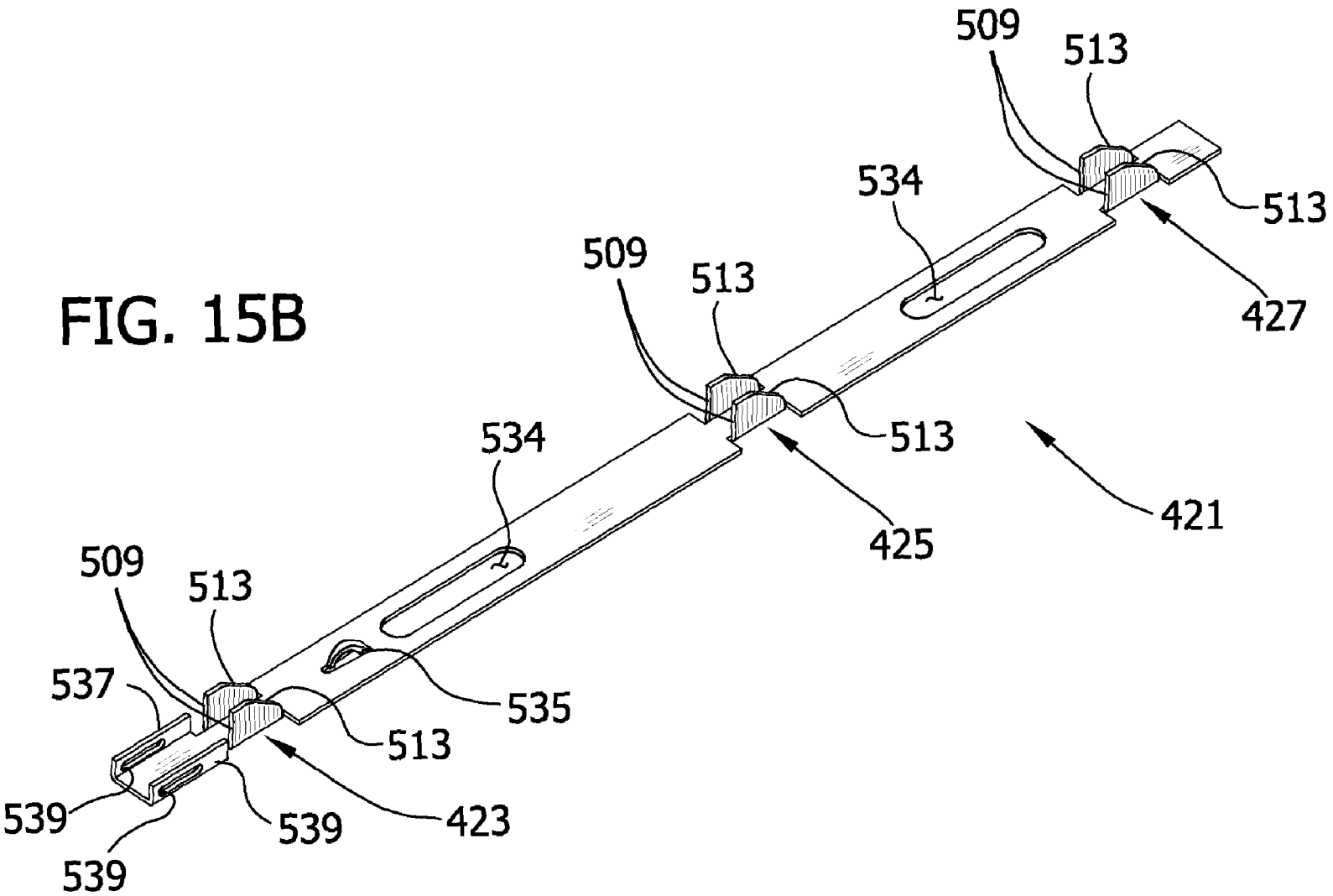
FIG. 15B is a bottom perspective of the travel bar.

A third embodiment of the present invention is shown in FIGS. 13-15 and is designated generally by reference numeral 401. Parts of this embodiment that correspond to parts of the first embodiment are indicated by the same reference numerals, plus "400". This embodiment is again similar to the first embodiment. As shown in FIGS. 13 and 14, it includes an actuating lever 439 similar to that of the mechanism 1 of the first embodiment, but that is capable of directly pivoting hinge plates 417, 419 for opening and closing ring members 449. In this mechanism 401, the lever 439 includes a closing arm 549 and an opening arm 551 for engaging the hinge plates 417, 419 to pivot them and move the ring members 449. The two arms 549, 551 extend generally perpendicular from the lever 439 and are generally parallel to one another. They are separated by a channel that receives a finger 555 (FIG. 13) of each hinge plate. Each finger 555 extends from an end of the hinge plate and is somewhat narrower than the rest of the hinge plate. When the hinge plates 417, 419 are positioned for pivoting motion in the housing 411, the fingers 555 jut out from the housing 411 and position in the lever's channel, allowing the lever 439 to drive the hinge plates for pivoting movement.

This mechanism 401 also includes an alternative intermediate connector in the form of a wire link 541. The wire link 541 is a thin wire having two ends that are both bent 90° in the same direction (FIG. 13) for connecting the actuating lever 439 to a travel bar 421. One end of the wire link is received in an aperture 547 in the closing arm 549 of the lever. The other end of the link is received in a slot 539 in one of two side flanges of the travel bar, where the side flanges 537 are formed by folding a section of both longitudinal edge margins of the travel bar downward 90°. As a result, the lever 439 can be moved a distance corresponding to the movement of the end of the link 541 through the length of the slot 539 without causing corresponding movement of the travel bar 421. It is feasible that two wire links could be employed. But it is understood that when one wire link is used, it can be positioned in a slot of either side flange without departing from the scope of the present invention. Similarly, mechanisms having only one slot or only one side flange do not depart from the scope of this invention.

As in prior embodiments, the actuating lever 439 of this mechanism 401 pivotally attaches to one end of a housing 411. The housing 411 includes two tabs 527 (FIG. 13) projecting downward from one housing end for receiving a hinge pin 529 to attach the lever 439. In addition, a raised plateau 431 of the housing 411 includes two openings 531 for receiving and attaching grooved rivets 533. Now referring particularly to FIG. 15A, the rivets 533 (only one of which is shown) slidably connect the travel bar 421 to the housing 411 through two slots 534 on the surface of the travel bar, permitting the travel bar 421 to move relative to the rivets 533 and generally lengthwise of the housing 411. This minimizes vertical movement of the travel bar 421 and its associated locking elements 423, 425, 427 when the hinge plates 417, 419 pivot to open or close the ring members 449 (i.e., this beneficially prevents the locking elements 423, 425, 427 from engaging a notebook's spine 403 (not shown) when the mechanism 401 is at an open position). Furthermore in this embodiment, the openings in the hinge plates are ordered slightly differently than in the first and second embodiments, accommodating a tension spring 429 oriented in this embodiment to bias the travel bar 421 and locking elements 423, 425, 427 away from the housing end having the lever 439. A first opening 557 is located near the housing end having the lever 439 and receives a first mounting post 445 through the hinge plates 417, 419. A second opening 559 receives a first locking element 423. A third opening 561 accommodates a body 469 of the tension spring. A fourth opening 563 includes notches 463 (FIG. 13) for receiving a second end 465 of the tension spring. Fifth and sixth openings 565, 567 receive second and third locking elements 425, 427, and a seventh opening 569, located near the housing end not having the lever 439, receives a second mounting post 447 through the hinge plates 417, 419.

At a closed and locked position (FIG. 15A) in this embodiment, the hinge plates 417, 419 are oriented with a pivot axis below a coplanar position (180°), and the travel bar 421 and locking elements 423, 425, 427 are relatively away from the housing end having the lever 439 (as compared to their positions in the first and second embodiments). When the lever 439 pivots for opening the mechanism 401, it pulls the wire link 541, travel bar 421, and locking elements 423, 425, 427 toward the housing end having the lever 439. But when the locking elements 423, 425, 427 register with the respective second, fifth, and sixth openings 559, 563, 567 in the hinge plates, the plates 417, 419 do not automatically pivot. The housing's spring force prevents it. Instead, the lever's opening arm 551 engages the undersides of the hinge plate's fingers, forcing the hinge plates 417, 419 to pivot upward and through the coplanar position (180°). Openings 559, 563, 567 in the hinge plates move over the corresponding locking elements 423, 425, 427 and the ring members 449 open. When the mechanism 401 is closed, the lever's closing arm 549 engages a top sides of the hinge plates' fingers, slowly pivoting the hinge plates 417, 419 downward and through the coplanar position (180°). The tension spring 429 contracts and pulls the travel bar 421 and locking elements 423, 425, 427 toward the housing end having the lever 439 (i.e., to the locking position). In this embodiment, the closing arm 549 alone pivots the hinge plates 417, 419 for closing the ring members 449. The locking elements 423, 425, 427 do not cam the plates 417, 419 to pivot unlike their counterparts in the first and second embodiments.

Figure 16:
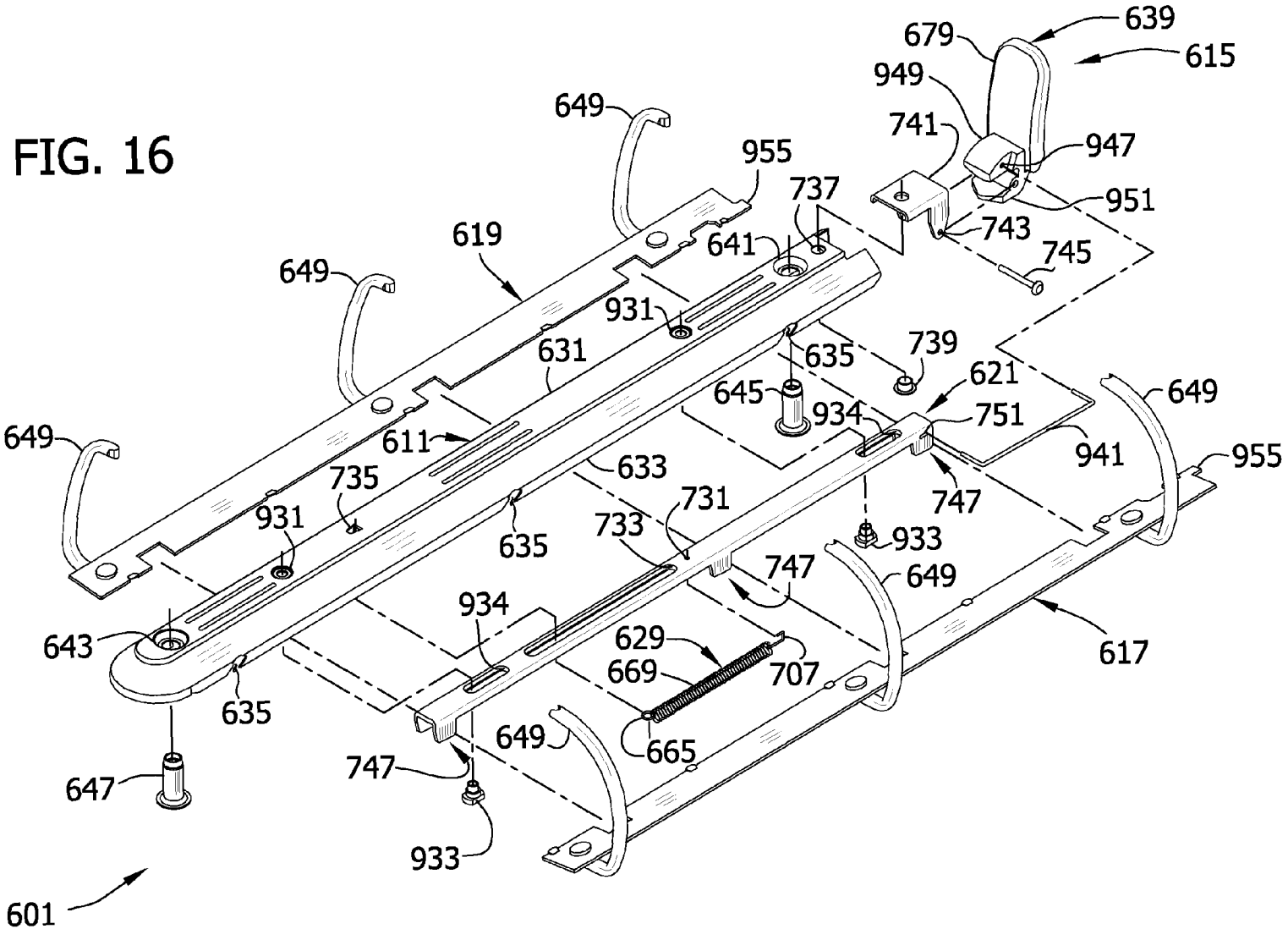
FIG. 16 is an exploded perspective of a ring binder mechanism of the present invention according to a fourth embodiment.
Figure 17A:
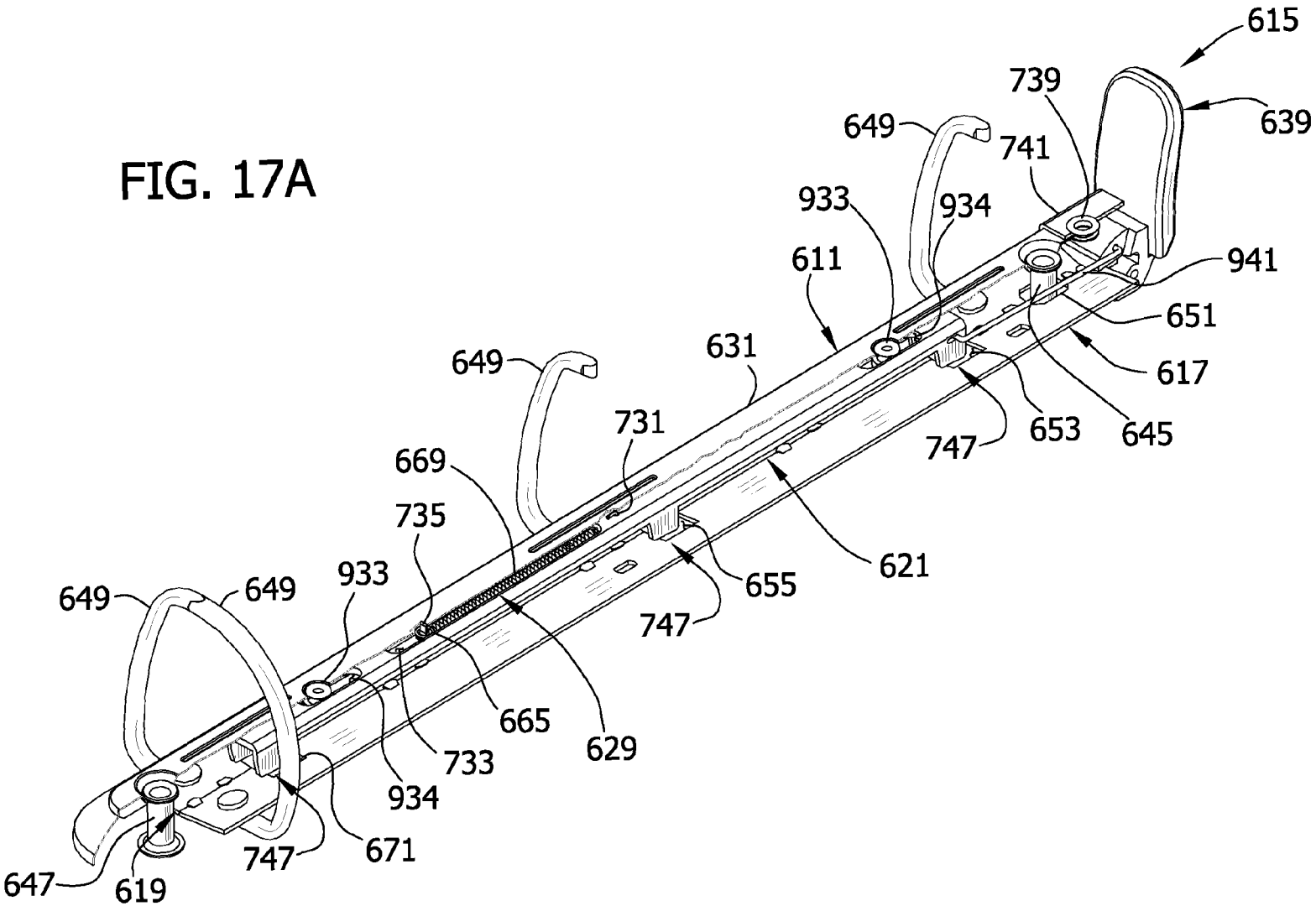
FIG. 17A is a perspective of the mechanism of FIG. 16 at a closed and locked position with a portion of a housing and ring members broken away.
Figure 17B:
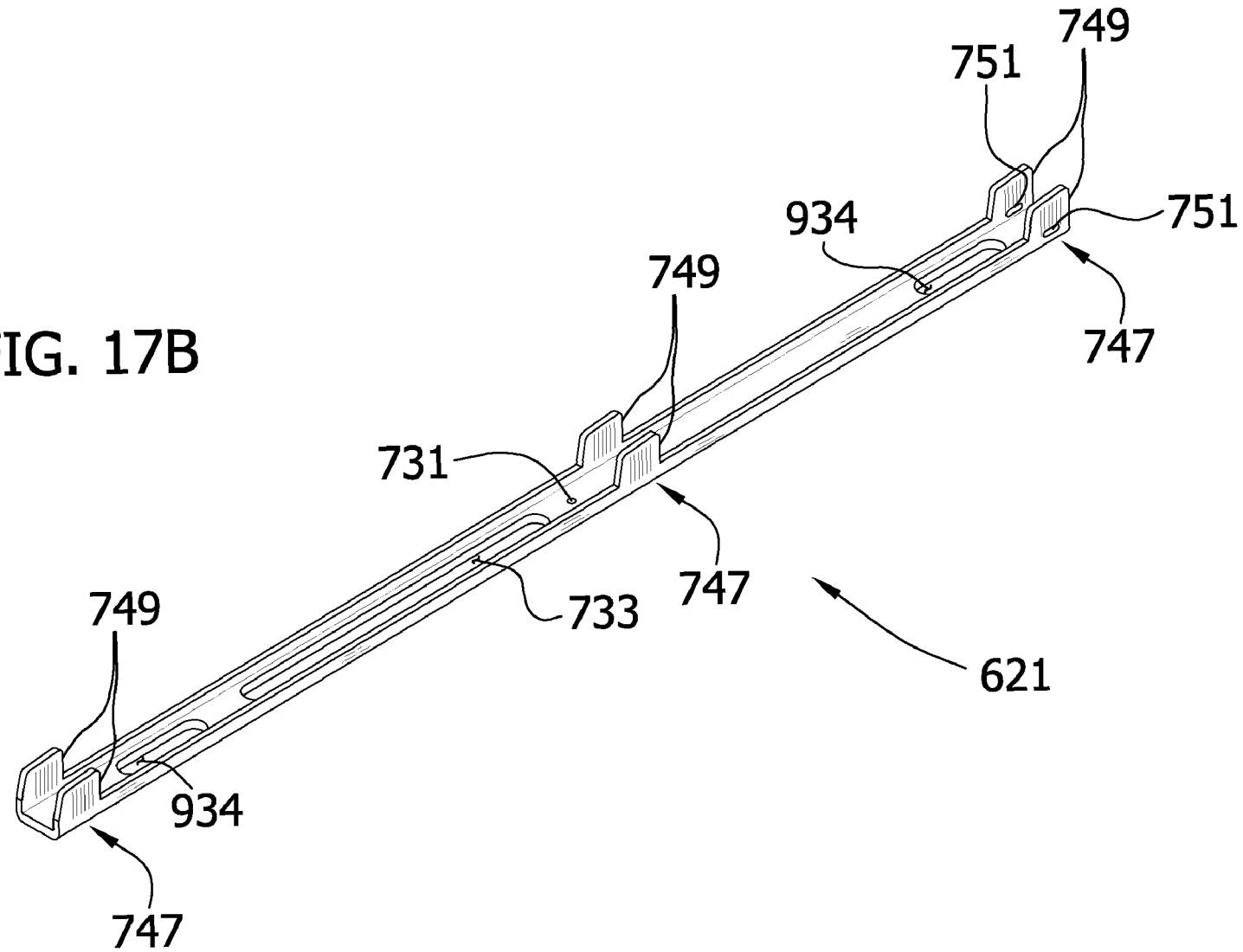
FIG. 17B is a bottom perspective of a travel bar of the fourth embodiment.

FIGS. 16-17B show a fourth embodiment of the present invention. The mechanism of this embodiment is generally described by reference numeral 601. Parts of this embodiment corresponding to parts of the first embodiment are indicated by the same reference numerals, plus "600". Parts corresponding to parts of the third embodiment, not included in the first embodiment, are indicated by the same reference numerals, plus "400". This embodiment is substantially similar to the third embodiment. But in this embodiment a first end 707 of a tension spring attaches to a travel bar 621 while a second end 665 attaches to a detent 735 in a raised plateau 631 of a housing.

Also in this embodiment, the travel bar 621 is shaped as a rigid channel having a flat web and two side flanges. It includes three locking elements 747 that each include two locking flanges 749 integrally attached to side flanges of the travel bar. The locking flanges 749 project downward from the side flanges at uniformly spaced longitudinal intervals so that three locking flanges 749 are on each side of the travel bar. A first pair of locking flanges are located toward the housing end having the actuating lever 639 and include a slot 751 for receiving one end of a wire link 941, which acts to connect the travel bar 621 to the actuating lever 639. The travel bar 621 further includes two additional openings 731, 733 in the web to accommodate the tension spring's alternate connection to the travel bar 621 and the housing 611. A first additional opening 731 is located near a longitudinal center of the travel bar and receives the tension spring's first end 707. A second additional opening 733 is located between the first additional opening 731 and a travel bar slot 934, and receives a portion of a tension spring body 669. Because the tension spring 629 does not attach to hinge plates 617, 619, the plates 617, 619 include only four openings (FIG. 17A). A first opening 651 is located near the housing end having the lever 639 and receives a first mounting post 645 through the hinge plates 617, 619, and second, third, and fourth openings 653, 655, 671 receive the three respective locking elements 747.

Moreover in this embodiment, the actuating lever 639 is identical to that of the mechanism of the third embodiment, but mounts on a separate lever mount 741. The lever mount 741 includes two downwardly projecting tabs 743 that receive a hinge pin 745 for mounting the lever 639 on the housing 611. The lever mount 741 attaches to the housing 611 by a rivet passing through an opening 737 in the housing's raised plateau 631. In all other aspects, this mechanism 601 operates identically to the mechanism 401 of the third embodiment.

In FIGS. 18-22, a fifth embodiment of a ring binder mechanism of the present invention is shown (designated generally by reference numeral 1001) substantially as described above and illustrated in the figures. In particular, the mechanism is substantially similar to the mechanism 601 of the fourth embodiment illustrated in FIGS. 16 through 17B, but for the modifications described hereinafter. Parts of this mechanism corresponding to parts of the mechanism of the fourth embodiment are indicated by the same reference numerals, plus "400." Referring now to FIGS. 18 and 19, this mechanism 1001 includes an actuating lever 1039 similar to the lever 639 described for the mechanism 601 of the fourth embodiment. It mounts on a separate lever mount 1141 at one longitudinal end of a housing and includes a closing arm 1349 and an opening arm 1351 for engaging fingers 1355 of hinge plates to open and close ring members 1049. But in this mechanism 1001, the lever 1039 is "T"-shaped with an elongate, enlarged head 1079 having a length oriented generally parallel to a longitudinal axis of the housing. The head 1079 is integral with the lever 1039 and ends of the head are bowed slightly upward to facilitate gripping and applying force to the lever 1039. It is to be understood, however, that the actuating lever 1039 may be directly mounted on the housing 1011 (see FIG. 22), as described for the mechanism 401 of the third embodiment and illustrated in FIGS. 13 through 15, without departing from the scope of the present invention.

Figure 18:
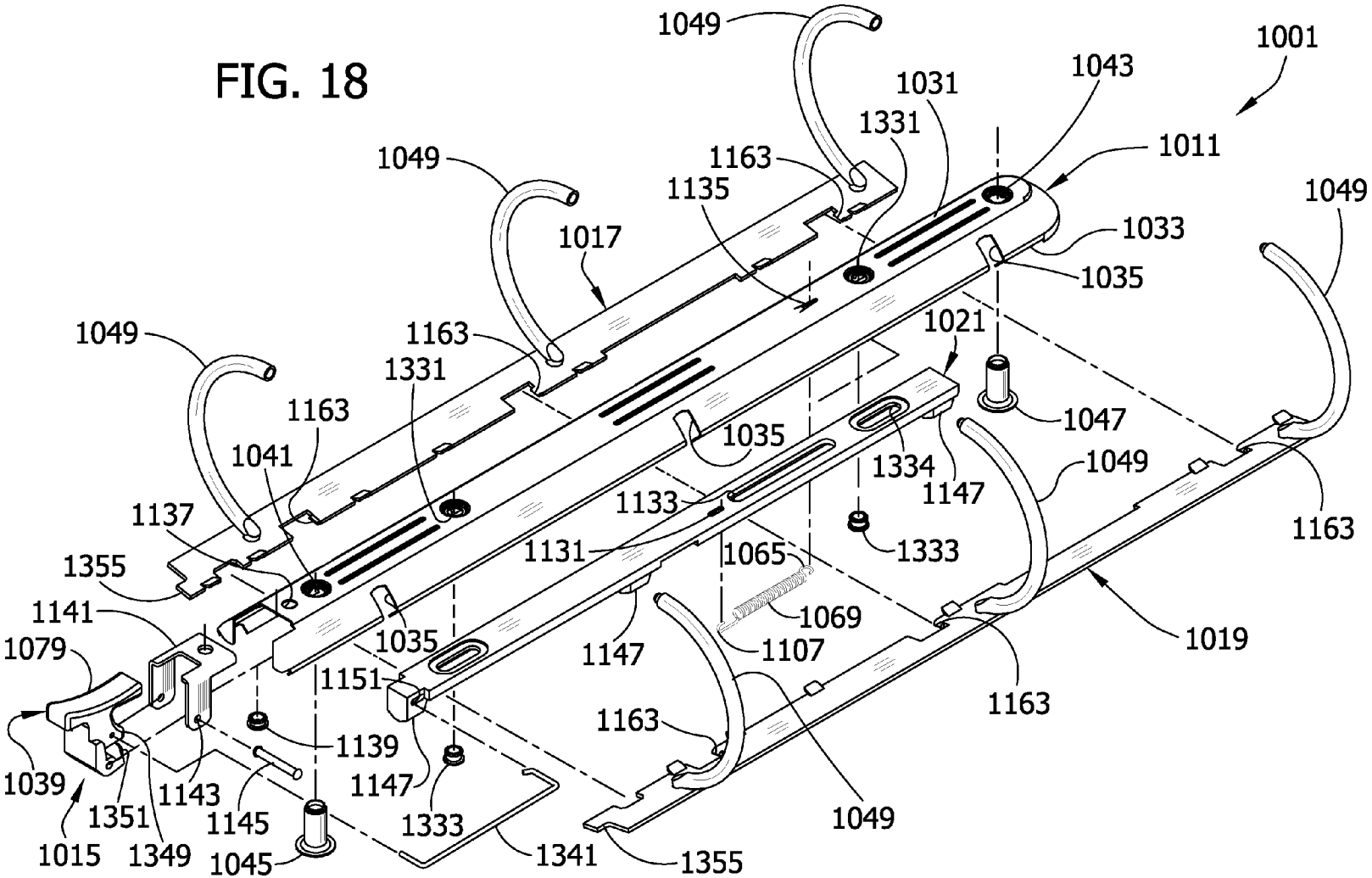
FIG. 18 is an exploded perspective of a ring binder mechanism of the present invention according to a fifth embodiment.
Figure 19:
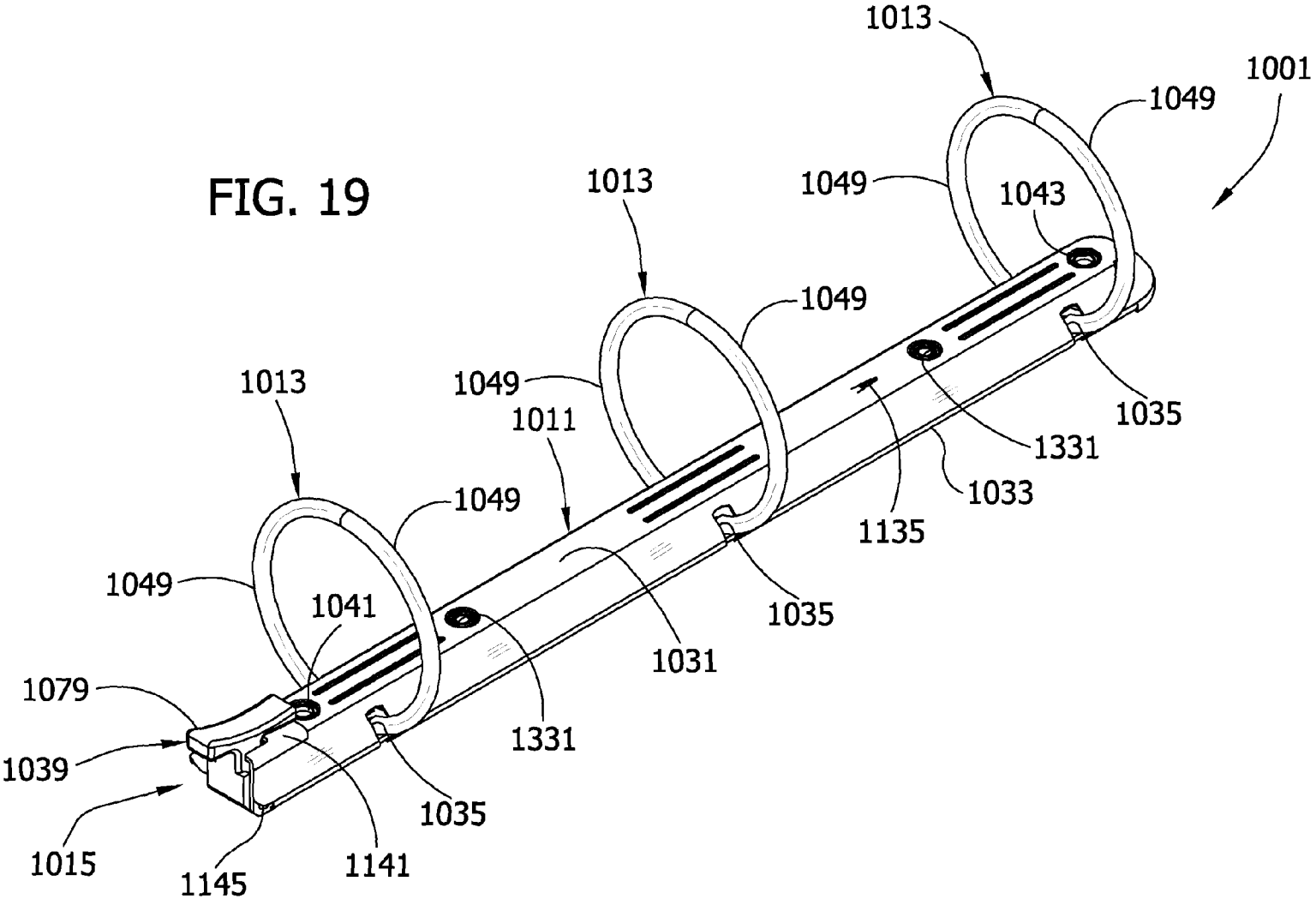
FIG. 19 is a perspective of the mechanism of FIG. 18 at a closed and locked position.
Figure 21:
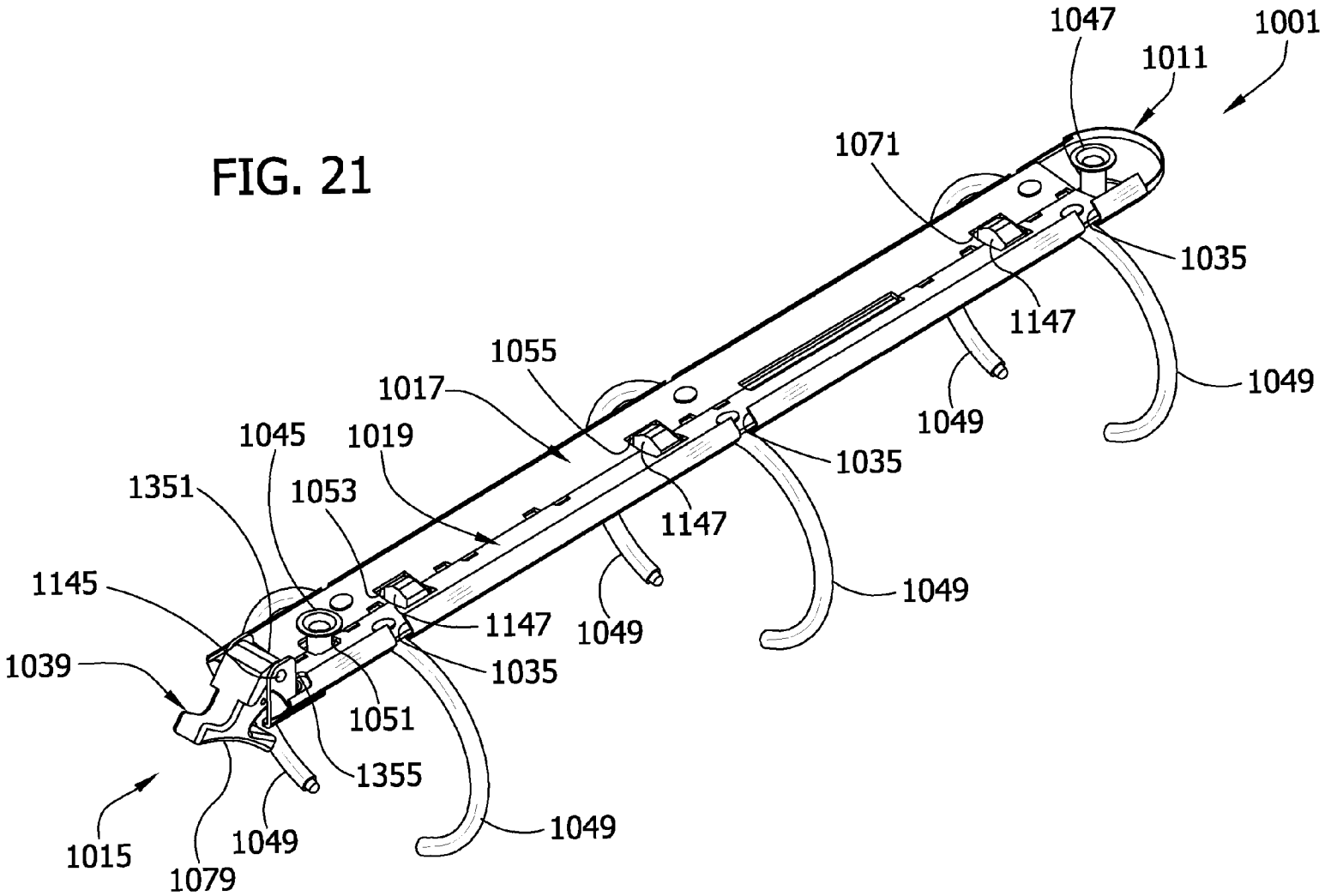
FIG. 21 is a perspective similar to FIG. 20 with the mechanism at an open position.
Figure 22:
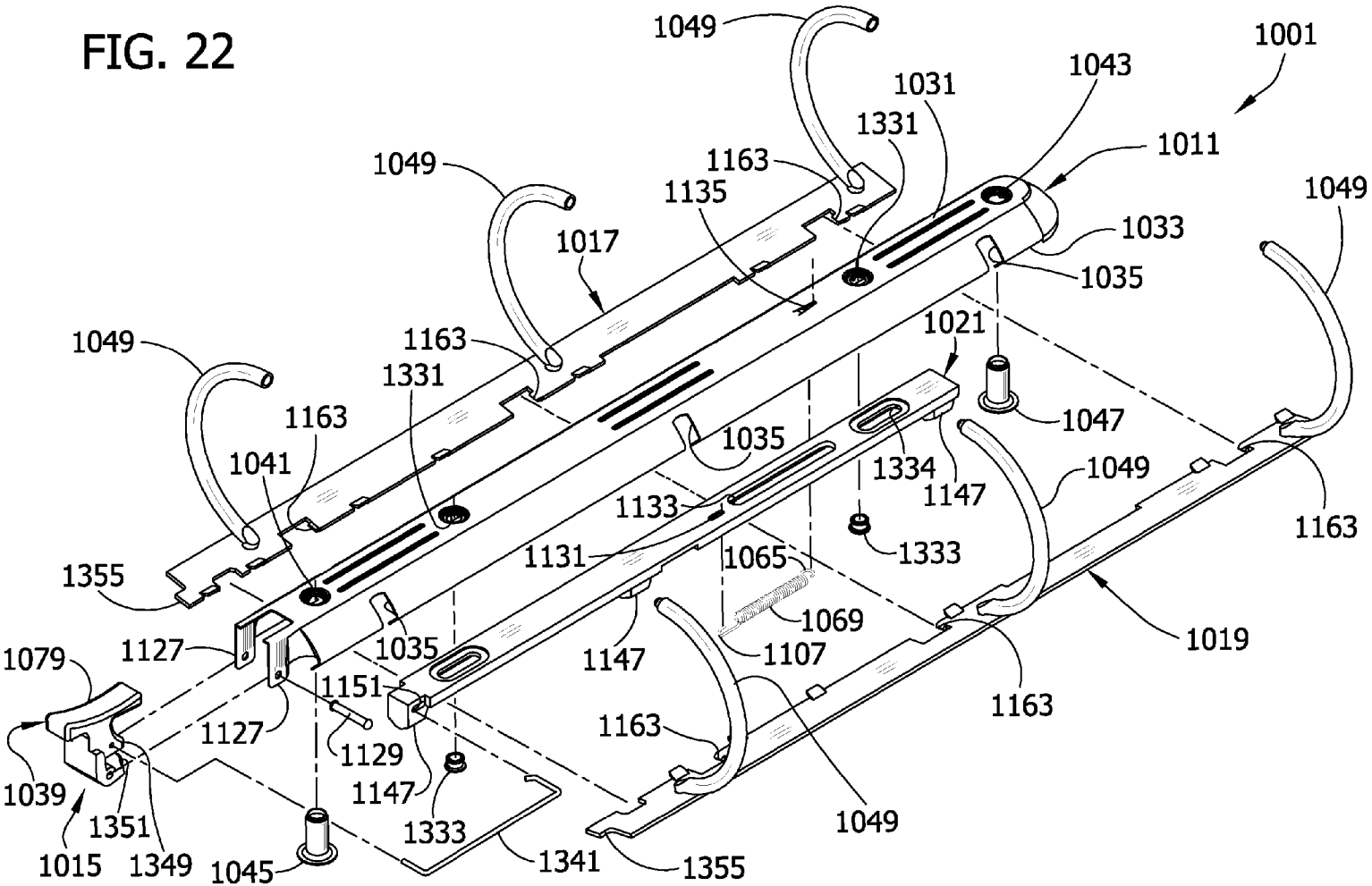
FIG. 22 is an exploded perspective of the ring binder mechanism of FIG. 18 illustrating an alternative method for mounting an actuating lever on a housing.

As with the actuating lever 1039, a travel bar 1021 of this mechanism is also similar to the travel bar 621 of the mechanism of the fourth embodiment. But in this mechanism 1001, as shown in FIGS. 18 and 21, the travel bar 1021 includes three generally block-shaped locking elements 1147 that are integrally attached to a web of the travel bar and project downward therefrom at uniformly spaced longitudinal intervals. It is to be understood, however, that mechanisms with locking elements separately attached to a travel bar do not depart from the scope of the present invention. The locking elements 1147 include relatively flat side surfaces and a bottom surface that tapers to a narrow central area (see FIG. 21). Locking elements of other configurations do not depart from the scope of the present invention. A first locking element 747 is located toward an end of the housing having the lever 1039 and includes a slot 1151 for receiving a hook-shaped end of a wire link 1341, connecting the travel bar 1021 to the actuating lever 1039 in substantially similar fashion to the wire link 941 of the mechanism of the fourth embodiment.

Figure 20:
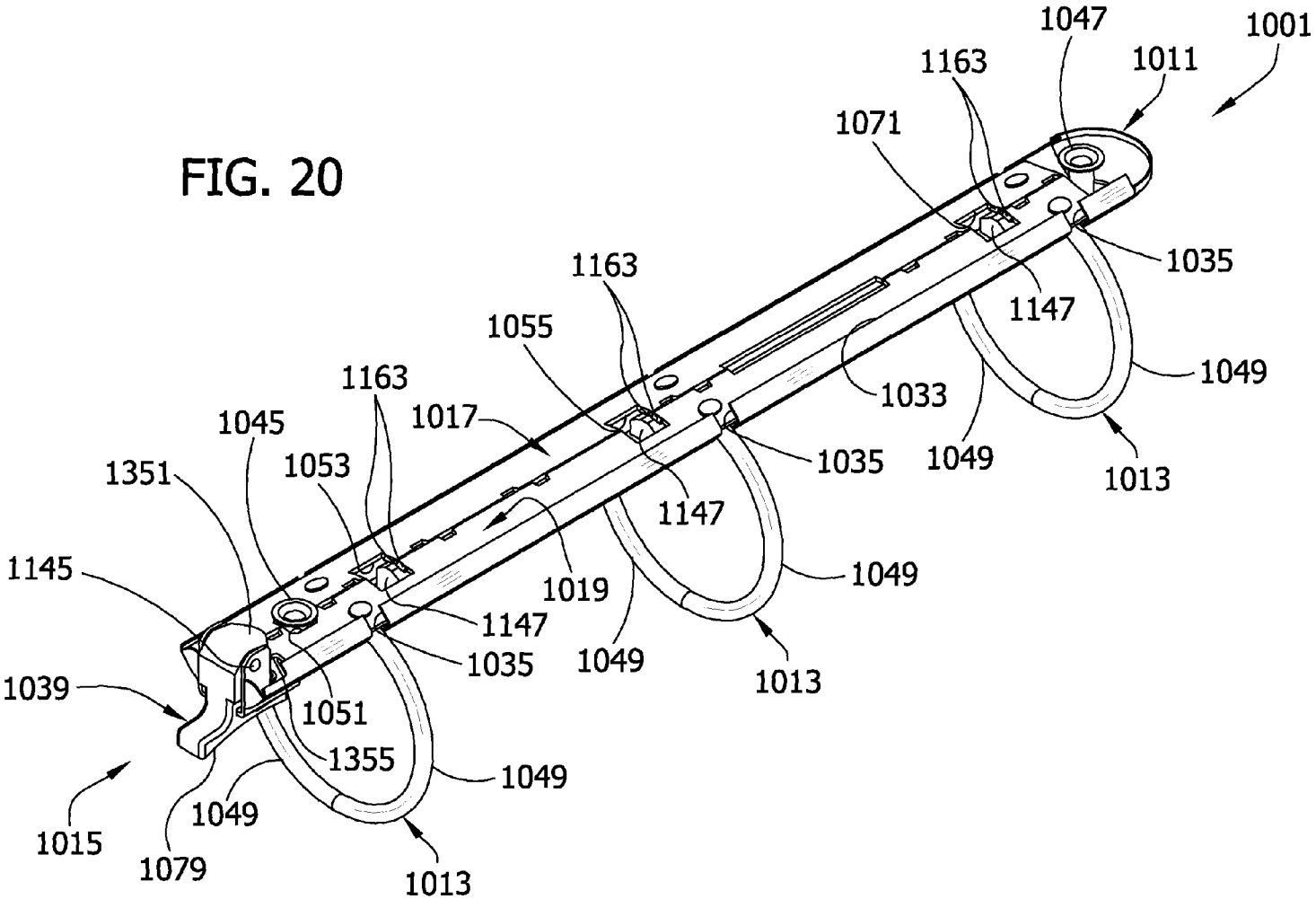
FIG. 20 is the perspective to FIG. 19 inverted.

As shown in FIGS. 18, 20, and 21, the hinge plates 1017, 1019 of this mechanism are also substantially similar to those of the mechanism of the fourth embodiment, but include a bent tab 1163 in each cutout. The tabs 1163 substantially prevent formation of burrs along edges of the cutouts (burrs often form on the edges of the cutouts when the cutouts are made in the hinge plates 1017, 1019). When the hinge plates 1017, 1019 interconnect, the tabs 1163 of corresponding cutouts are adjacent and are positioned in second, third, and fourth openings 1053, 1055, 1071 of the hinge plates. In particular, the tabs are located on an edge of each opening over which the corresponding block-shaped locking element 1147 passes as it moves between a position in registration with the opening and a position out of registration. Thus, the tabs 1163 aid movement of the block-shaped locking elements 1147 into and out of registration with the second, third, and fourth openings 1053, 1055, 1071 of the hinge plates and prevent excessive wear of the locking elements 1147 as they repeatedly slide over the respective edges of those openings. It is to be understood that these tabs 1163 can be used generally with the hinge plates of each mechanism described herein, and are not limited to the hinge plates 1017, 1019 of the mechanism of this embodiment.

Some other differences between this mechanism 1001 and the mechanism 601 of the fourth embodiment include that in this mechanism 1001 the ring members 1049 extend from a top surface of each hinge plate for movement between a closed position and an open position. Also in this mechanism 1001, in the closed position the ring members 1049 form a substantially continuous, closed, circular ring or loop (see FIG. 19) for retaining loose-leaf pages and for allowing those pages to move along rings 1013 from one ring member 1049 to the other. Ring binder mechanisms having other ring member configurations do not depart from the scope of the present invention.

Referring now to FIGS. 20 and 21, operation of this mechanism is substantially similar to operation of the mechanism of the fourth embodiment. To open the ring members 1049, an operator engages an end of the lever's elongate head furthest from the housing 1011, causing the lever 1039 to pivot outward and downward. This pulls the wire link 1341 and travel bar 1021 toward the end of the housing having the lever 1039, moving the locking elements 1147 into registration with the corresponding openings 1053, 1055, 1071 of the hinge plates. The opening arm 1351 of the lever engages the fingers 1355 of the hinge plates and causes the plates 1017, 1019 to pivot upward to open the ring members 1049. To close the ring members 1049, the operator engages an opposite end of the lever, causing the lever 1039 to pivot upward and inward. The closing arm 1349 engages the fingers 1355 of the hinge plates and pivots the plates 1017, 1019 downward and over the locking elements 1147, closing the ring members 1049 and allowing a tension spring 1029 to pull the travel bar 1021 back to a locking position.

Components of the several embodiments of the ring binder mechanism of the present invention are made of a suitable rigid material, such as a metal (e.g. steel). But mechanisms having components made of a nonmetallic material, specifically including a plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing comprising opposite longitudinally extending edge margins and a central portion located between the edge margins;

first and second hinge plates supported by the housing for pivoting motion about a pivot axis relative to the housing;

rings for holding loose-leaf pages, each ring including a first ring member mounted on the first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

an actuator pivotally mounted on the housing and movable relative to the housing for controlling the pivoting motion of the hinge plates opening and closing the ring members;

a travel bar moveable longitudinally in the housing by the actuator into position for blocking the pivoting motion of the hinge plates when the ring members are closed, the travel bar having a flat surface facing toward the central portion of the housing;

wherein the actuator can be moved in a range without actuating corresponding movement of the travel bar.

2. A ring binder mechanism as set forth in further comprising an intermediate connector connecting the travel bar to the actuator, the intermediate connector being pivotally connected to the travel bar and pivotally connected to the actuator.

3. A ring binder mechanism as set forth in claim 2 wherein the travel bar has an elongate slot and the intermediate connector is received in the elongate slot.

4. A ring binder mechanism as set forth in claim 3 wherein the travel bar comprises a side flange and the elongate slot is in the side flange.

5. A ring binder mechanism as set forth in claim 2 wherein the intermediate connector converts rotational movement of the actuator into linear movement of the travel bar.

6. A ring binder mechanism as set forth in claim 2 wherein the intermediate connector comprises a wire link.

7. A ring binder mechanism as set forth in claim 1 wherein the travel bar is slideably connected to the housing.

8. A ring binder mechanism as set forth in claim 7 further comprising a plurality of rivets, the rivets being received in elongate slots in the travel bar to connect the travel bar to the housing.

9. A ring binder mechanism as set forth in claim 7 wherein vertical movement of the travel bar is limited by the connection of the travel bar to the housing.

10. A ring binder mechanism as set forth in claim 9 wherein the intermediate connector converts rotational movement of the actuator into linear movement of the travel bar.

11. A ring binder mechanism as set forth in claim 1 wherein the travel bar comprises a web, said flat surface of the travel bar being part of the web, and the mechanism includes a locking element projecting from the web in a direction away from the central portion of the housing.

12. A ring binder mechanism as set forth in claim 11 wherein the locking element is integrally formed with the travel bar.

13. A ring binder mechanism as set forth in claim 1 wherein the travel bar is between the hinge plates and the central portion of the housing.

14. A ring binder mechanism as set forth in claim 1 wherein the travel bar is moveable longitudinally in the housing by the actuator away from said position for blocking the pivoting motion of the hinge plates to a position in which the travel bar does not block pivoting motion of the hinge plates to move the first ring member relative to the second ring member from the closed position to the open position.

15. A ring binder mechanism as set forth in claim 14 wherein the mechanism further comprises a locking element moveable with the travel bar, the locking element having a cam surface operable to pivot the hinge plates.

16. A ring mechanism as set forth in claim 15 wherein the cam surface of the locking element engages an edge of a cutout in the hinge plates, the hinge plates including bent tabs at said edge of the cutout to facilitate movement of the locking element from a position in registration with the cutout to a position out of registration with the cutout.

17. A ring binder mechanism for retaining loose-leaf pages, the mechanism comprising:

a housing;

first and second hinge plates supported by the housing for pivoting motion about a pivot axis relative to the housing;

rings for holding loose-leaf pages, each ring including a first ring member mounted on the first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

an actuator pivotally mounted on the housing and movable relative to the housing for controlling the pivoting motion of the hinge plates opening and closing the ring members;

a travel bar moveable longitudinally in the housing by the actuator into position for blocking the pivoting motion of the hinge plates when the ring members are closed, the travel bar having an elongate slot therein;

an intermediate connector connecting the actuator to the travel bar, the intermediate connector being received in the slot in the travel bar whereby the actuator can be moved in a range without actuating corresponding movement of the travel bar.

* * * * *